US007380292B1

(12) United States Patent
Harris

(10) Patent No.: US 7,380,292 B1
(45) Date of Patent: Jun. 3, 2008

(54) TOILET MODULAR SYSTEM WITH VENTILATION AND AUTOMATION DEVICES

(76) Inventor: Robert Marion Harris, PO Box 972, North Highlands, CA (US) 95660

( * ) Notice: Subject to any disclaimer, the term of this patent is extended or adjusted under 35 U.S.C. 154(b) by 0 days.

(21) Appl. No.: 11/935,672

(22) Filed: Nov. 6, 2007

(51) Int. Cl.
*E03D 9/04* (2006.01)

(52) U.S. Cl. ..... 4/213

(58) Field of Classification Search ..... 4/213–217, 4/246.1–246.5, 347–352
See application file for complete search history.

(56) References Cited

U.S. PATENT DOCUMENTS

| | | | | |
|---|---|---|---|---|
| 3,495,282 | A | 2/1970 | Taggart | |
| 3,849,808 | A | 11/1974 | Olson | |
| 3,916,459 | A | 11/1975 | Ivancevic | |
| 4,094,023 | A | 6/1978 | Smith | |
| 4,103,370 | A * | 8/1978 | Arnold | 4/213 |
| 4,165,544 | A | 8/1979 | Barry | |
| 4,365,361 | A | 12/1982 | Sanstrom | |
| 4,402,091 | A | 9/1983 | Ellis | |
| 4,494,255 | A | 1/1985 | Drummond | |
| 4,800,596 | A * | 1/1989 | Menge | 4/348 |
| 5,079,782 | A | 1/1992 | Sim | |
| 5,361,422 | A * | 11/1994 | Vincent et al. | 4/213 |
| 5,519,899 | A * | 5/1996 | Taylor | 4/349 |
| 5,638,553 | A | 6/1997 | Loewen | |
| 5,704,074 | A * | 1/1998 | Baldea | 4/213 |
| 5,724,682 | A | 3/1998 | Johnson | |
| 5,727,262 | A | 3/1998 | Littlejohn | |
| 5,802,623 | A * | 9/1998 | Vincent | 4/209 R |
| 5,906,009 | A | 5/1999 | Sakar | |
| 6,202,226 | B1 | 3/2001 | Shoptaugh | |
| 6,545,567 | B1 | 4/2003 | Kuzniar | |
| 6,637,040 | B1 | 10/2003 | Alba | |
| 6,678,900 | B2 | 1/2004 | Ware | |
| 6,694,534 | B2 | 2/2004 | Stone | |
| 6,701,538 | B2 | 3/2004 | Hunnicutt | |
| 6,772,449 | B1 | 8/2004 | Wolfe | |

* cited by examiner

*Primary Examiner*—Charles E Phillips

(57) ABSTRACT

A modular multifunction device designed to take full advantage of its strategic placement as mounted on a toilet's water tank to automate various toilet area functions of which any one or number of its capabilities can be utilized. The apparatus can either be attached to an existing toilet in a structure as an aftermarket product or manufactured in combination with a toilet. The modular nature of this invention allows a wide range of configuration options which helps make it universally applicable to virtually any toilet and any bathroom. One primary function of its modular case is to function as an automatic toilet ventilator, which vacuums objectionable odor from the toilet bowl and exhausts it to the sewer discharge line or to other optional depositories. A unique seat and seat lid is designed to function as an inconspicuous ventilation duct that draws the air from the circumference the toilet bowl to a vacuum pump that is camouflaged as mounted inside a modular case which is shaped to blend in with the existing toilet design. Other functions of this invention include the mechanisms and the automatic electronic control circuitry for features such as motors and related linkage to open and close the toilet seat and seat lid, automatic flush control, automatic ventilator control and convenience power outlet control.

14 Claims, 26 Drawing Sheets

TOILET MODULAR SYSTEM WITH VENTILATION AND AUTOMATION DEVICES

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

The present invention relates in general to toilet automation and ventilation systems and more particularly to a new modular multifunction apparatus that mounts onto most standard toilets to provide the capability to automate numerous toilet related functions. Although its primary purpose is intended to function as an automatic toilet bowl ventilation system, the device can be fitted without the ventilation components since its modular nature allows it to be configured with any one or all of its other features, such as an automatic flushing system, seat and seat lid motion system and sound generation system.

The conventional method of bathroom ventilation involves the removal of bathroom odors after the odors departure from the toilet bowl and dispersion in the ambient air. Modern bathrooms tend to be small windowless rooms with tiny, inadequate exhaust fans mounted in the ceiling with ducting leading to the outdoor air. Upon activation, said systems attempts to draw odorous air out of the bathroom. Because the odor is removed after its dispersion from the toilet, said systems require lengthy operation time to ventilate the entire bathroom area and are thus are often ineffective in removing the odor. The ineffectiveness these ceiling exhaust fans has encouraged the development of ventilating means which draws the unwanted gases and odors directly from the toilet bowls before the odors can disperse into the surrounding air. These systems then expel the odorous air into an air filtration unit or to the outdoors through a ventilation duct. Over the years, numerous of such ventilation systems have been designed to solve the bathroom odor problem. Prior art includes a multitude of methods for removing odors from toilet bowls. However, these designs suffer from a number of problems, as discussed below.

Many of the prior art toilet ventilation systems disclosed in the patents are technical in complexity and relatively high cost to manufacture, requiring a whole new toilet installation. This kind of prior art has the major disadvantage or drawback of not being adapted for easy mounting or compatible with the wide variety of existing toilet configurations and designs. Examples of such systems that are complicated and/or would require a new toilet installation include U.S. Pat. No. 6,637,040 (Alba), U.S. Pat. No. 5,079,782 (Sim) and U.S. Pat. No. 4,165,544 (Barry).

Many of the prior art toilet ventilation systems require a dedicated wall ventilation duct near the toilet. As many bathrooms do not have such an available duct, this type of ventilated toilet installation would require expensive structural modification of the building to provide for the ventilation conduits. Examples of prior art that need a dedicated bathroom ventilation duct can be seen in U.S. Pat. No. 4,402,091 (Ellis), U.S. Pat. No. 5,906,009 (Sakar), U.S. Pat. No. 5,638,553 (Loewen), U.S. Pat. No. 3,495,282 (Taggart) and U.S. Pat. No. 6,678,900 (Ware).

Many of the prior art have designs that use weak battery operated fans that cannot possibly move enough air on a regular basis to effectively perform the job of removing odors from the bowl before they escape into the bathroom. Examples of battery operated units can be seen in U.S. Pat. No. 6,701,538 (Hunnicutt), U.S. Pat. No. 6,694,534 (Stone) and U.S. Pat. No. 6,546,567 (Kuzniar).

Other prior art designs incorporate air duct passageways that are far too small to move enough air to make the units effective. Even if enough air was to somehow be pulled through their tiny passageways, unacceptable obnoxious noise would be produced. A common approach of units that use inadequate ventilation ducting and then suffer from insufficient airflow volume to adequately ventilate the toilet can be seen in U.S. Pat. No. 6,772,449 (Wolfe), U.S. Pat. No. 5,724,682 (Johnson) and U.S. Pat. No. 4,094,023 (Smith).

Many of the prior art are rather unsightly in the bathroom, using bulky components that are visible to a person using the toilet, which detracts from the overall appearance of the bathroom. Examples of these kinds of prior art can be seen in U.S. Pat. No. 5,727,262 (Littlejohn), U.S. Pat. No. 4,365,361 (Sanstrom) and U.S. Pat. No. 3,849,808 (Olson).

Many prior art designs use devices that present cleaning and odor problems that is inherent when the units mount on or adjacent to the toilet since these designs use ductwork passages that are exposed to the toilet bowl and can easily become contaminated. Keeping these toilet area parts clean can be a challenge, considering the normal toilet bowl environment. Since they can be very hard to clean, infectious waste can collect there and can then produce more odor to the bathroom environment than the system is trying to eliminate. Ventilation units of this design can be seen in U.S. Pat. No. 4,494,255 (Drummond), U.S. Pat. No. 3,916,459 (Ivancevic) and U.S. Pat. No. 6,202,226 (Shoptaugh).

In general, none of the existing ventilation systems for removing odors directly at the toilet have been commercially successful. There is still a need for an economical toilet ventilation system that is easily connectable to the toilet bowl and works efficiently. It would also be beneficial to have a ventilation system that has a similar appearance to a standard toilet seat and toilet bowl and had minimal cleaning and maintenance requirements.

SUMMARY OF THE INVENTION (A) Modular Design of the Current Invention:

The present invention is a modular multifunction device that provides numerous desired automatic functions for toilets and bathrooms which can either be attached to an existing toilet as an aftermarket product or manufactured in combination with a toilet. A very important object of this invention is to use a modular construction that will not only facilitate the addition of optional system accessories but maximizes the usefulness of the accessories by providing for a variety of ways to implement their basic functions. Consequently, the current modular device would be able to take advantage of whatever existing bathroom ventilation system may be available or desirable by using specialized modular kits or by utilizing the various modular parts within the kits in optional ways. Although this modular design can provide a multitude of very useful automated features in total, the device can be comprised with any one or any number of them. For instance, if a user is not interested in the toilet ventilation system component, but only prefers to use the automatic seat and lid lowering apparatus, then many of the same parts can still be used. In the event that more features are later desired, they can still be easily be added to the basic system.

(B) Modular Case:

The centerpiece of the present invention is a unique modular case that is strategically placed on top of the toilet's water tank, inserted between the water tank and the water tank's lid. This modular case provides the housing for the major ventilation components of this invention as well as provides the space, framework and electrical connections for many other optional automation features thereby creating a whole multifunction system. The modular nature of this case allows the convenient addition of other components that can be installed anytime into or onto the modular case as an add-on option or product. Some of the optional components include a proximity sensor and motion detector to help start and stop some of the cycles of the automatic features, a flushing device, components for motorized toilet seat and seat lid raising and lowering, automatic convenience power receptacles and a sound generation device.

Numerous prior art that utilized fan units near the toilet were unsightly, where the fan unit was mounted on the floor beside or behind the toilet base. Not only was this arrangement unsightly, it presented additional sanitation and cleanliness problems to the bathroom. The present invention fully disguises the fan or vacuum pump assembly by encasing it inside the modular case that is shaped to fit and blend in with the existing toilet design. The aesthetics of the toilet then appear more normal, with the appearance of only a slightly taller than usual water tank. The modular case could be provided with its own integral or detachable lid, but reusing the existing toilet water tank lid would retain the original look of the toilet.

This invention takes full advantage of its position as mounted onto the water tank, which allows the modular case to be in close proximity to other toilet apparatus, such as the toilet seat, toilet seat lid, the flush handle actuator lever, the water inside the water tank and other components. This position above the toilet also is the perfect place to mount a motion sensor, proximity device, and easy to reach control panels. This position also allows easy installation of the device as it merely sits on the water tank, without the need for fasteners. Guides on the case's bottom mates with the water tank's rim to keep the case securely in place. The top of the modular case has a rim just like the water tank so that the original lid can be attached to it. The modular case is also specially designed to be easily removed so that quick service to the components inside the water tank can be made, such as freeing up a stuck flush valve.

Another feature of the modular case is that other components can be attached or stacked onto the top of it to add yet other unique features, thus allowing it to work with other modular devices under development by the same inventor. Although the additional features can be also built into the modular case, for the sake of modularity, some additional devices may be best kept as separate devices similar to a component stereo system. The modular cases can also share and take advantage of each others' resources, such the use of power supplies and electronic control circuits. For example, a control line from the modular case's electronic control module could be accessed by another modular case to activate or trigger its circuitry so that the units may work together in concert. Another example would be to allow a second device to share the power supply of the modular case to save the need for numerous power cords.

(C) Ventilation System Design:

The ventilation part of this invention is designed to solve the bathroom odor problem by exhausting odorous air from the toilet bowl and seat area before the odor is allowed to escape. This system efficiently removes the odor-filled air from in and around the toilet bowl and transports it from the bowl through a very unique ductwork sequence to the outside environment. This ductwork sequence is so diverse that it can use any one of the three commonly used methods to handle the treatment of the odorous air: (i) the sewer plumbing drain to vent it outdoors, (ii) an available bathroom exhaust duct to vent it outdoors or (iii) an air filtration apparatus to filter odor causing elements from the air. The components of this ventilation system includes a toilet seat, a toilet seat lid, an exhaust duct, an exhaust manifold, optional ventilation ductwork for multiple configurations and a water tank mounted modular case that includes a snorkel duct, a vacuum pump, a P-Trap, a backup for the P-Trap and electronic control circuits. One main feature of the modular case is to provide the heart of this ventilation system, which houses many of its components.

(D) Toilet Seat Cavity and Seat Lid Cavity Function as Unique Ductwork:

Many prior art utilize bulky ductwork that attaches to the side or back of the toilet that greatly detracts from the normal bathroom aesthetics. The current invention solves the ductwork aesthetics problem by its unique utilization of the toilet seat and seat lid that forms a ventilation duct to communicate the odor filled air from the toilet bowl to a snorkel duct that is mounted to the modular case on the water tank. The combination of the seat and the seat lid completes a ductwork path after the seat lid is raised. The special seat and seat lid are designed with duct passages so that once the lid is raised, a duct joint at the back end of the seat and the bottom of the open seat lid mate to form a complete air channel that joins the air that circumferences the toilet bowl with the vacuum pump that is mounted inside a modular case that is mounted on the water tank. By using the seat lid as the main ductwork to the vacuum pump, the duct inside the seat lid is thus disguised. The ductwork becomes retractable, inconspicuously folding up and down within the seat lid. Never does it appear as any form of ductwork is attached to the toilet, thus the toilet maintains the clean, streamlined traditional look and function of the traditional toilet.

(E) Toilet Sanitation and Cleaning:

A further object of this invention is to provide the maximum sanitation and wholesomeness in bathrooms. One of the biggest drawbacks of the previous art is that the ductwork systems have inadequate sanitation. Many prior art are deficient in that they utilize obtrusive ducting that hangs to the side or back of the toilet bowl. Not only is this arrangement visually unacceptable, it provides for yet another toilet area sanitary problem, where the ducting can become easily contaminated making them difficult if not impractical to clean, which is wholly unacceptable. Microscopic organisms can thrive and propagate in the pores and seams produced by the type of evacuation devices that are permanently secured to either the bowl or the seat. This arrangement of bulky, hard to clean and smelly ductwork could result in more bathroom odors being released from the ductwork to the bathroom environment than the apparatus was designed to remove in the first place.

The current invention solves the sanitary problem by eliminating the need for smelly ductwork that would have to be mounted in or around the toilet bowl. This invention utilizes a unique snorkel duct that protrudes from the modular case that is located on top of the water tank, far away from any direct contact from the toilet bowl environment and hence will not be subject to the collection of splashed contaminates. The ductwork that does extend down to the proximity of the toilet bowl in order to directly collect the odorous air is actually part of the seat and seat lid, which is always part of the bowl area environment anyway. This ductwork is disguised as the toilet seat and seat lid which is normally folded down or closed, which then breaks the duct channel to the snorkel duct. This also makes the ductwork inconspicuous. A duct passageway is thus automatically constructed each time the seat lid is raised, and disappears as an air duct when the seat lid is lowered. The upper part of the seat lid duct mates with the snorkel duct that protrudes from the modular case. The lower end of the seat lid duct perfectly mates with another duct cavity inside the toilet seat. The snorkel duct is thus not continuously exposed to contaminants that could creep up permanently arranged duct and thus it will always remain clean and dry. The only ductwork that can be contaminated is that inside the seat and seat lid. Consequently, the seat and seat lid are designed with covers that snap off quickly and easily which will completely expose the duct cavities. A duct cover can be snapped off the underside of the seat to easily expose the cavity of the seat duct for easy cleaning. Likewise, a duct cover on the underside of the seat lid can be snapped off to expose the seat lid duct cavity for easy cleaning. These covers will allow the duct cavities to be easily kept just as clean as a normal toilet seat. Unlike close ended ductwork, the ductwork inside this special seat and seat lid are open on both ends, so that air can normally circulate in, around and through it so that the ductwork will keep the same level of hygiene as a normal seat and seat lid and would not require more frequent cleaning intervals.

(F) Universal P-Trap Design:

Many previous art designs utilized the toilet sewer drain as a means of communicating the toilet bowl odors away from the bathroom. This type of system vents the odors through a type of toilet base exhaust manifold device that allows a ducting port into the existing sewer drain system of the building. Though functional, this type of system has the problem of the sewer gas escaping into the indoor ambient air creating a dangerous and unhealthy situation, because a typical sewer environment often contains combustible gases, such as methane. In order prevent sewer gas backflow into the indoor ambient air, some previous art utilized the long accepted and established P-Trap method of sewer gas blockage. P-traps are incorporated in existing toilet designs and used on all indoor plumbing, and is required for use under most plumbing codes. Previous inventions that utilized said P-Trap were often very complicated, often requiring a whole new, specialized toilet assembly. This would preclude the utilization of using the idea as an add-on product to an existing toilet and would be cost prohibitive.

Although the present invention allows the possibility of several ways to treat the odor filled air from the toilet, the inventor believes the most popular choice would be the utilization of said toilet base exhaust manifold design since most bathrooms tend not to have ventilation ducts available near the toilet. Several objectives of the current invention is to (i) utilize the sewer drain style apparatus to provide a plumbing code approved method of toilet ventilation, (ii) provide that the apparatus be aesthetically appealing in design, and (iii) provide the ability for it to be easily installed onto most toilets in kit form.

The current invention offers a means to communicate odorous air to the sewer drain that meets the above criteria. A vacuum pump, located in the modular case on the water tank, will deliver the odorous air that is collected by the seat and seat lid ductwork to a P-Trap, which is also mounted in the modular case. The P-Trap then communicates with a thin exhaust duct that is attached to the backside of the modular case that inconspicuously follows the contours of the toilet base to a sewer exhaust manifold, which is mounted under the toilet's base. A cavity inside this exhaust manifold completes the duct path from the exhaust duct to the sewer drain.

Yet another unique feature of this invention is the design and use of its P-Trap. The invention takes advantage of the proximity of the ductwork inside the toilet's water tank mounted modular case with the water inside the water tank located just below the modular case. The P-Trap is simply added to the ductwork as it exits the vacuum pump and is allowed to extend down into the tank's water supply. A small orifice and water valve located at the bottom of the P-Trap duct will allow the tank's water to enter the trap and fill it to the level of the water tank. This will completely submerge the P-Trap's ductwork cavity thus blocking any path for sewer gas backflow. Once the vacuum pump is actuated, the initial air blast will blow the small amount of water out of the P-Trap and down the ductwork to the sewer. The air pressure created inside the P-Trap with the vacuum pump running will act on the water valve so that it will move to close off the orifice to prevent more water from re-entering the P-Trap. An unobstructed duct passage would then exist from the vacuum pump to the sewer drain. Once the vacuum pump stops, the P-Trap's water valve will float up because the valve is buoyant and because normal water pressure would be exerted on it. The tiny orifice in the P-Trap will then allow the water to refill it and will remain open, with the water valve just floating in the water just above the orifice.

This invention satisfies the previously stated objectives, since (i) a P-Trap as used in this invention to prevent sewer gas backflow of sewer gas into the building and therefore is qualified to use under plumbing code requirements, (ii) aesthetics of this design are pleasing, since the P-Trap is hidden inside the modular case and the thin exhaust duct at the back of the toilet base is mostly hidden from view, and (iii) the whole P-Trap and manifold system can be very easily installed to most toilets.

(G) Ball-Trap Backup:

Another unique feature of this invention is the design and use of a "Ball-Trap." This device is meant to be a secondary or backup for the P-Trap which is designed to block sewer gas from entering the ductwork, should the P-Trap fail. A P-Trap failure could occur if the toilet is flushed without enough building water pressure to refill the water tank, (if the water supply gets shut off), and therefore, refilling the P-Trap. The Ball-Trap is a specially shaped duct that is in series with the P-Trap and contains an exhaust orifice and a ball that normally rests on the orifice with enough pressure to effectively seal the orifice, thus forming a backup for sewer gas backflow. The short Ball-Trap duct is angled upward so once the vacuum pump activates, the air pressure can push the ball up and away from the orifice thereby uncovering it. The air can then flow through the orifice and then on to the sewer drain. Once the pump stops, gravity will move the ball back down again to rest against the exhaust orifice that will block off the passageway to the sewer drain, thus preventing sewer gas from entering the system.

(H) Toilet Seat and Seat Lid Automation:

Another common toilet problem is that the toilet seat and or seat lid are left open. Females especially complain about the seat being left open after a male uses the toilet. She may inadvertently choose to sit down on the toilet without realizing this, resulting in her bottom contacting the porcelain base. An open seat lid could also bring real harm to marauding pets, whom consider the toilet a great place to obtain a cool drink of water. This water could contain germs that the pet could spread around the house and could also contain hazardous chemicals that could harm the pet, such as commonly used bowl cleaners. A toilet seat or seat lid that is left open can also make the bathroom look less tidy.

The current invention solves the above problem by providing yet another automation feature of the modular case, which has the supporting structure and electrical control elements for two small electric motor assemblies that can raise and lower the toilet seat and seat lid. The modular case contains two sockets on the backside surface of the case so that seat and seat lid motor assemblies can be snapped into place to be functional and yet remain out of view. One motor for the seat and another for the seat lid are simply snapped almost flush into the sockets. These motor sockets have electrical connectors that allow the instant electrical conductivity to the mating contacts in the motor assembly cases as they are snapped into place. This connects the motors to circuitry installed inside the modular case to allow power and control to automatically (or manually) operate the motors. Since the motor assemblies are mounted behind the modular case, they are thus hidden from view. A guide tube containing a linear actuator rod from each of the motor assemblies, along with a bracket and hinge arrangement is used to allow the motors to actuate the seat and seat lid. The design and length of each guide tube and motor assembly allows for the clean and sanitary mounting of the motor assembly as described in the remote location behind the water tank and away from the immediate vicinity of the toilet bowl. The modular case also houses an occupant proximity sensor and the required circuitry to determine when to automatically lower the seat and seat lid.

The modular nature of each motor assembly not only allows for a quick hardware and electrical installation to the modular case but also provides the ability to be just as quickly and conveniently disconnected and removed from the modular case. This allows a user to quickly remove the modular case from the toilet to service the water tank's components.

(I) Automatic Flushing of the Toilet:

Another common toilet problem is that of an unflushed toilet. An unflushed toilet is a very unwelcomed sight, which may be quite embarrassing for the person who left it that way as well as for the person who then discovers it. Nobody wants to forget this responsibility. Although this may be an infrequent event for adults, this "forgetting to flush" inaction is a very frequent event among children. This is not only unsightly, but the condition leaves the toilet in an unsanitary condition. This could result in more toilet stains and buildup, causing more frequent cleanups and extra work.

The current invention solves this problem by automatically flushing the toilet after use. Another feature of the modular case is to provide the mounting structure for yet another automation device that can flush the toilet. The case provides a dedicated place over the flush handle actuator lever to mount a solenoid or similar device that has the ability to mechanical lift the actuator lever, thereby flushing the toilet. The modular case is designed to accommodate a proximity sensor, which will detect that someone is using the toilet. Once the proximity sensor senses the toilet's occupancy and then detects a vacancy, the flush device will activate, which will pull up on the flush handle actuator lever thus flushing the toilet.

(J) Sound Generation Device:

Many apartments and homes are built with very thin walls and doors that allow sounds to easily penetrate them. Many people are terrified with the possibility of "bathroom noises" being overheard. To save this embarrassment, some people are known to repeatedly flush the toilet to produce a background noise that is intended to hide any other noises that might be made in the bathroom, and wasting a lot of water in the process.

The current invention helps solve this problem by automatically activating a sound producing device once the toilet seat lid is opened. Yet another feature of the modular case is to provide a removable front panel that can accommodate a sound producing module. Although the vacuum pump in the ventilator system produces some amount of noise, the sound level is low and rather consistent. A sound producing device with prerecorded music or sound effects and a volume level control can adequately mask any normal bathroom sounds. Indeed, one of the selections of sounds from the sound generator could be the sound of a continually flushing toilet. The sound module can be controlled by the central control circuitry of the modular case or could use its own built-in amplifier and recording circuitry.

The modular nature of this invention allows most any type of sound producing device to be installed, including devices that offer an unlimited number of sound possibilities including music players that use user installed CDs or removable compact memory chips that allow the consumer to provide his own recordings.

The current invention could also provide an electrical signal to activate and deactivate a remotely located fully featured CD or DVD player.

(K) Automatic Activation of Convenience Power Receptacles:

Another feature of the modular case is to house a motion detector and electrical power receptacles and switches to automatically turn on a night light or other product that is plugged into the modular case's receptacles. The modular case allows a motion sensor to be disposed on the front exterior of the case that is free of interference from the opening and closing of the toilet seat and seat lid. This feature allows the detection of motion in the proximity of the toilet and can trigger a standard device or appliance that is connected to one of the receptacles. As an example, the receptacles could be used with night lights that can automatically illuminate a dark bathroom once a person walks near the sensor. The modular case can be equipped with a switch that can also manually activate the receptacles so that they can be powered all the time.

(L) Toilet Aesthetics:

A further object of the current invention is to provide an inconspicuous and unobtrusive device to maintain the look of the traditional bathroom. The current invention achieves this by the previously mentioned features: (i) the ductwork that is shaped inside the seat and seat lid is inconspicuous; (ii) the toilet water-closed mounted modular case that contains most of the invention's components is shaped like the water tank so as to blend in with the existing facility, making it inconspicuous.

(M) Automatic Operation:

A very important object of the modular case is to provide the mounting and automatic control of numerous devices that can individually, or in concert, perform many types of toilet area functions. The modular case houses an electronic module containing a microprocessor and other circuit components to operate as the central logic of the current invention to control many of the attached components, such as the ventilator, seat and seat lid motors, flush actuator and sound generation system. The modular case has front panels that have sensors and switches for controlling the automation devices.

One important automation feature of this invention is to provide automatic control for its odor ventilation system. This system is activated by a magnetically operated switch responsive when the seat lid is raised. The seat lid has a small magnet embedded at the top edge that activates a magnetically operated switch that is mounted in the modular case. Once the seat lid is completely raised, the magnet in the lid will activate the switch in the modular case, that will send the signal to the control unit that the lid is raised and to then activate the ventilator vacuum pump. Once the seat lid is lowered, the magnetic switch will open, signaling the control circuit to deactivate the vacuum pump.

Still another important object of this invention is to have the capability of automatically raising and lowering the toilet seat and seat lid. Electrical switches mounted in the modular case allow for this control. Activating the seat lid switch will signal the control circuit to raise only the seat lid. Activating the seat button will signal the control circuit to raise both the seat lid and the seat. An occupancy proximity sensor mounted in the modular case will detect that a person is present in front of the unit indicating that the toilet is in use and will automatically lower the seat and seat lid once the proximity sensor senses the toilet's vacancy.

Still another object of this invention is to have the capability of automatically flushing the toilet. A proximity sensor mounted on the front panel of the modular case along with an electronic control module is used to determine when the toilet has been used and when the toilet should be flushed. The control module will then actuate a solenoid or similar device to mechanically raise the flush handle actuator lever thereby flushing the toilet.

(N) Universal Applications:

A further object of the present invention is to provide equipment that will have universal application to a wide variety of existing installed toilets as well as its inclusion in newly manufactured toilets. The current invention achieves this objective by its modular design which greatly extends its usefulness. Its modular structures can be supplied with optional parts that provide a very wide variety of different methods of use. This allows tremendous flexibility so that its components can be universally applicable to nearly any style of existing toilet and to most any situation.

The primary component of this invention requiring the concern for universal application is the water tank mounted modular case. The current invention is designed so that the components that make up the modular case can be mass produced in a generic, one size fits all package to reduce manufacturing costs. This modular package can then be installed inside any desired modular case shape or "skin" that is designed to blend in with specific toilet model aesthetics. For example, a universal modular package that contains many of the internal components of the modular case can be used by any number of toilet manufacturers. The modular package can then be installed into virtually any case shape or skin designed to perfectly fit each different model toilet. This modular package could also be offered in a generic "one size fits all" case shape or skin that is designed to work on and look good with a wide range of brands and models, thus enhancing the ability to more widely use this product on existing toilets.

The toilet seat and seat lid part of this invention are inherently universal since they are modeled after the several industry standard shapes and sizes that are available and have been widely used for many years. Adoption of these components onto any standard toilet is as easy as just replacing the stock parts. The fit of the new parts would be the same.

Another objective of this invention that allows it to have universal appeal is its ability to be readily adaptable to a wide varying range of installation conditions. The current invention provides this capability again by its modular nature. The invention can be offered in a form of a kit with a variety of parts for several configurations so that the consumer can install only the desired components for his application. Here are some examples:

(i) If a bathroom is already equipped with an exhaust vent near the toilet, the consumer will likely want to use it. Consequently, the consumer could purchase a kit that is intended for this application. The exhaust manifold would not be required as well as the P-Trap and Ball-Trap inside the modular case. Instead, the kit could include several duct shapes that could allow the modular case to be easily connected to the existing exhaust vent.

(ii) In the above case, if the existing toilet exhaust vent also has an attic mounted fan attached, then the consumer could purchase a kit that does not include a vacuum pump in the modular case. Though most of the ventilation components of the modular case would be replaced with a simple connecting duct from the snorkel duct to the exhaust duct, the customer would still be able to appreciate the seat and seat lid air collection devices of this invention along with all the available optional automation devices.

(iii) If the consumer wants the most inexpensive toilet ventilator kit with no frills, then a kit could be used that has only the most basic components that still gets the ventilation job done. For example, the special toilet seat with its duct cavity that is designed to pull air from the circumference of the toilet bowl could be omitted from the setup. Since this seat is merely a way to enhance the collection of air from the toilet bowl, the system could still work acceptably well without it. The air collection from the bowl would then be assigned to the bottom edge of the seat lid duct, which is in very close proximity the bowl. This would save the consumer the cost of the special seat. Note also, that the special seat lid with its duct cavity could also be omitted from the system, further saving the consumer the cost of the special seat lid. An optional duct could be used that can be attached to the water tank that provides a path from the toilet bowl to the snorkel duct without the special seat lid. This option would allow the current invention to still be utilized when the customer wants to keep his existing seat and seat lid, which may be made of some special material or have a custom design.

(iv) In the absence of an existing bathroom exhaust vent, the exhaust manifold would be believed my many to be the best method of exhausting the toilet bowl odors. However, some consumers may not want to install the manifold, which would require its insertion under the toilet's base. Apartment dwellers may not want to worry about removing it when they vacate even though it would be easy to do so. Therefore, to make the current invention as universal as possible, it has been designed to accommodate even an air filtration unit that could be added to the modular case. As part of the current invention, a modular air filtration unit was designed to be mounted on top of the modular case. Only a small duct change would be required for the device to work. This air filtration unit is shaped to fit the water tank just like the modular case so that it can blend in with the décor of the bathroom.

As yet another alternative, again to be as universal as possible, the current invention can also would allow its use with any brand air filtration unit that is remotely located near the toilet. The air filtration unit could have its own built in vacuum pump or not. A simple duct from the modular case to the air filtration unit is all that is required for the system to work.

(v) If a consumer is not interested in a bathroom ventilation device at all, but wants the toilet to automatically flush, or wants the seat and seat lid to be automatic, or wants any of the other features of this invention, then the consumer can only purchase the kit to accomplish this. The modular nature of this invention allows it to work with any one or all of its features. Even then, the features can be modified as the above example illustrates.

(vi) If a consumer later wants to add other automation components to any existing configuration of the current invention, then the consumer only needs to acquire a kit that is designed to add that capability. For instance, if the consumer wants to add the capability of automatically raising and lowering the toilet seat and seat lid, then the consumer could purchase a kit that contains those parts, such as the two motor assemblies and brackets.

(O) Exhaust Manifold Utilization:

The present invention eliminates the need for a dedicated bathroom exhaust vent and instead provides an exhaust port directly into the existing sewer drain system of the building. This invention vents odors directly into the sewer drain though an exhaust manifold mounted under the toilet's base. As this device taps into the sewer drain, concern for the process of sewer gas backflow prevention is addressed by a special P-Trap mechanism located in the modular case. In general, this type of an exhaust manifold design makes it universally applicable to nearly any style of existing toilet.

(P) Cost Efficiency:

It is the general aim of the present invention to provide a toilet bowl odor venting system in accordance with the preceding objects and which will (i) conform to conventional forms of manufacture and be of simple construction, (ii) be inexpensive for the consumer, and (iii) be energy efficient to operate.

(i) The present invention utilizes a cost effective and simple manufacturing process which provides universal and economical application of the present invention to existing bathroom equipment. As previously mentioned, the current invention is designed so that the components that make up the modular case can be mass produced in a generic, one size fits all package to reduce manufacturing costs. This modular package can then be installed inside any desired modular case shape or "skin" that is designed to blend in with specific toilet model aesthetics. For example, the universal modular package can be used by any number of toilet manufacturers and only requires its installation into the various case skins designed for each different model toilet. This modular package could also be offered in a generic case that is designed to work on and look good with a wide range of brands and models, thus enhancing the ability to more widely use this product on existing toilets. A reduction in manufacturing costs results in a more attractively priced unit for the consumer.

(ii) The present invention is made of few and rather simple components that are easy to manufacture; hence it should be inexpensive to produce. It does not require replacement of existing toilets or reconstruction of the bathroom interior to accommodate the system, or involve extensive mechanical apparatus. Hence the system will be inexpensive for the consumer to acquire and utilize.

(iii) The present invention is designed to be energy efficient. The system is designed to remove odor from the toilet bowl where it originates, before the odor has escaped into the indoor ambient air. Consequently, the present invention moves far less air, and uses far less energy than conventional systems which remove odor after is has escaped into the bathroom. Through the use of an electronic control system in the modular case, the operation of the invention is automatic, thus assuring system shut down and preventing wasted operation time.

(Q) Reliability:

A further objective of the present invention is a simplistic design that provides maintenance free operation and long term reliability of the system. The present invention has a minimum of moving parts, among which includes a proven reliable vacuum pump assembly which is designed to provide the consumer with maintenance free operation and long life.

(R) Easy Installation:

It is another object of this invention to provide an apparatus capable of easy installation onto an existing toilet of generally standard design that requires no alterations in the toilet, nor any alterations in the walls, floor or ceiling. Another goal of this invention is for it to be easily added to an existing toilet and just as easily removed again, such as would be desired by apartment dwellers. The current invention accomplishes this through a very simple design that allows it to be offered in kit form that can be easily installed or uninstalled on conventional toilet structures requiring no professional skill or special tools for installation. As an example, the main component of the invention is the modular case, which is simply sat down in place on top of the water tank.

(S) Summary of Features:

In summary the present invention provides a code approved, universal, reliable, energy efficient and cost effective solution to bathroom odor removal and also provides for many important automation functions. Its simple design and modular nature assures low cost availability to consumers and universal application to existing bathroom equipment.

Although only a few embodiments of the present invention have been described, it should be understood that the present invention may be embodied in many other specific forms without departing from the spirit or the scope of the present invention. The present examples are to be considered as illustrative and not restrictive, and the invention is not to be limited to the details given herein, but may be modified within the scope of the appended claims along with their full scope of equivalents.

The above-mentioned objectives and advantages of this invention and the manner of attaining them will become more apparent and the invention itself will be best understood by reference to the following detailed descriptions of the invention taken in conjunction with the accompanying drawings.

DRAWINGS-REFERENCE NUMERALS

Figure 1:
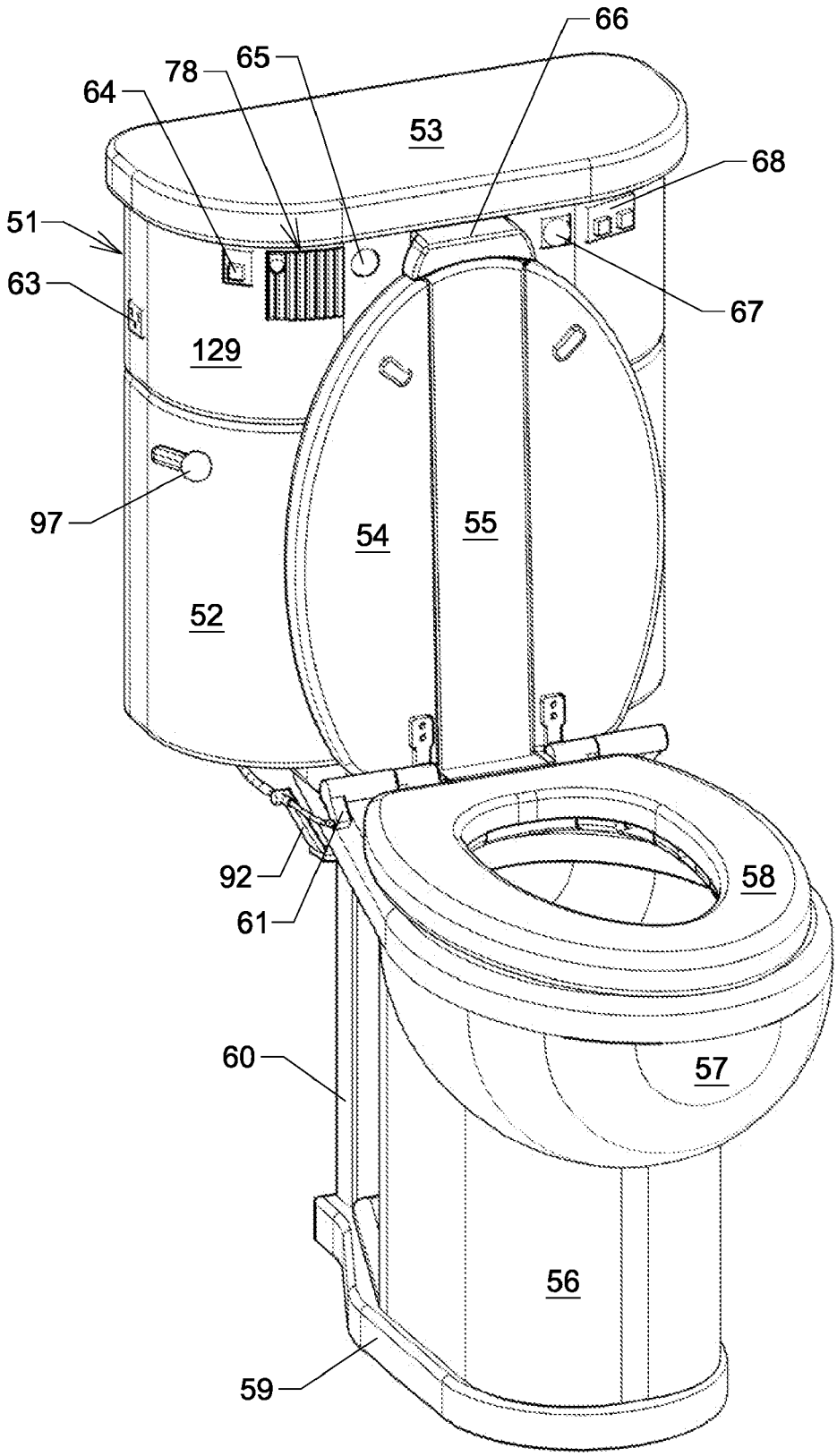
FIG. 1 is a front perspective view of the invention with many of its components installed in a basic configuration as mounted on an average toilet, with the seat lid up illustrating the unit as in an active state.

| | |
|---|---|
| 51 | Modular Case Assembly |
| 52 | Water tank |
| 53 | Lid, Water tank |
| 54 | Lid, Seat |
| 55 | Cover, Seat Lid Duct |
| 56 | Base, Toilet |
| 57 | Bowl, Toilet |
| 58 | Seat |
| 59 | Manifold, Exhaust |
| 60 | Duct, Exhaust |
| 61 | Lever, Seat Lid Hinge |
| 62 | Lever, Seat Hinge |
| 63 | Receptacle, Power Receptacle Convenience |
| 64 | Switch, Power |
| 65 | Sensor, Proximity |
| 66 | Duct, Snorkel |
| 67 | Detector, Motion |
| 68 | Panel, Seat Control |
| 69 | Motor |
| 70 | Assembly, Motor And Clutch |
| 71 | Gearbox |
| 72 | Bolt, Seat Lid And Seat Fastener |
| 73 | Socket, Ac Power Input |
| 74 | Pillar, Hinge Mounting |
| 75 | Pump, Vacuum |
| 76 | Module, Electronic Control |
| 77 | P-Trap |
| 78 | Assembly, Sound Generation Module |
| 79 | Orifice, Toilet Sewer |
| 80 | Socket, Motor and Clutch Assembly for Seat Raising/Lowering |
| 81 | Socket, Motor and Clutch Assembly for Seat Lid Raising/Lowering) |
| 82 | Port, Exhaust |
| 83 | Actuator, Toilet Flush |
| 84 | Chain, Toilet Flush Actuator |
| 85 | Ball-Trap Assembly |
| 86 | Valve, P-Trap Water |
| 87 | Water |
| 88 | Joint, Seat Lid Duct (to Snorkel) |
| 89 | Joint, Seat Duct (to Seat Lid) |
| 90 | Joint, Seat Lid Duct (to Seat) |
| 91 | Duct, Toilet Bowl Ventilation |
| 92 | Bracket, Seat Lid Raising/Lowering Actuator Cable Support |
| 93 | Bracket, Seat Raising/Lowering Actuator Cable Support |
| 94 | Tube, Actuator Guide |
| 95 | Rod, Actuator |
| 96 | Cavity, Wax Seal (to Sewer Orifice) |
| 97 | Handle, Flush |
| 98 | Lever, Flush Handle Actuator |
| 99 | Unit, Air Filtration Remote |
| 100 | Duct, Exhaust To Air Filtration Duct Adaptor |
| 101 | Orifice, Seat Duct |
| 102 | Cavity, Seat Duct |
| 103 | Cavity, Exhaust Manifold |
| 104 | Cavity, Seat Lid Duct |
| 105 | Magnet, Flush Handle Attachment |
| 106 | Unit, Air Filtration Modular |
| 107 | Drawer, Air Filter |
| 108 | Filter, Air |
| 109 | Vent, Air Filter Unit Exhaust |
| 110 | Duct, Air Filtration Unit Inlet |
| 111 | Guide, Air Filtration Unit Mounting |
| 112 | Duct, Air Filtration Exhaust |
| 113 | Orifice, P-Trap |

-continued

| | |
|---|---|
| 114 | Ball, Ball-Trap |
| 115 | Orifice, Ball-Trap |
| 116 | Duct, Ball-Trap (to P-Trap) |
| 117 | Joint, Manifold Exhaust Duct |
| 118 | Cover, Seat Duct |
| 119 | Duct, Exhaust To Wall Vent |
| 120 | Pump, Attic Vacuum |
| 121 | Magnet, Seat Lid |
| 122 | Switch, Magnetic |
| 123 | Duct, Wall Exhaust |
| 124 | Grill, Speaker |
| 125 | Speaker |
| 126 | Knob, Multifunction Control |
| 127 | Module, Electronic Amplifier |
| 128 | Duct, Exhaust (to Air Filtration Unit) |
| 129 | Skin, Modular Case |
| 130 | Assembly, Generic Case |
| 131 | Rim, Modular Case |
| 132 | Guide, Modular Case Mounting |
| 133 | Jack, Seat Warmer Power Outlet |
| 134 | Cover, Sound Generation Module |
| 135 | Slots, Adjustment Guide |
| 136 | Chassis, Clutch Housing |
| 137 | Shaft, Gearbox Output |
| 138 | Shaft, Output Drive Clutch |
| 139 | Threads, Output Drive Shaft Clutch |
| 140 | Coupler, Gearbox Output Shaft |
| 141 | Spacer, Chassis Clutch Housing |
| 142 | Coupler, Actuator Rod |
| 143 | Shaft, Linear Actuator Clutch |
| 144 | Threads, Linear Actuator Clutch |
| 145 | Plate, Tension Back |
| 146 | Plate, Pressure |
| 147 | Spring, Tension |
| 148 | Latch, Motor and Clutch Case Assembly |
| 149 | Terminals, Motor Electrical |
| 150 | Screw, Tension Adjustment |
| 151 | Fitting, Quick Disconnect |

DETAILED DESCRIPTION OF THE DRAWINGS

Figure 2:
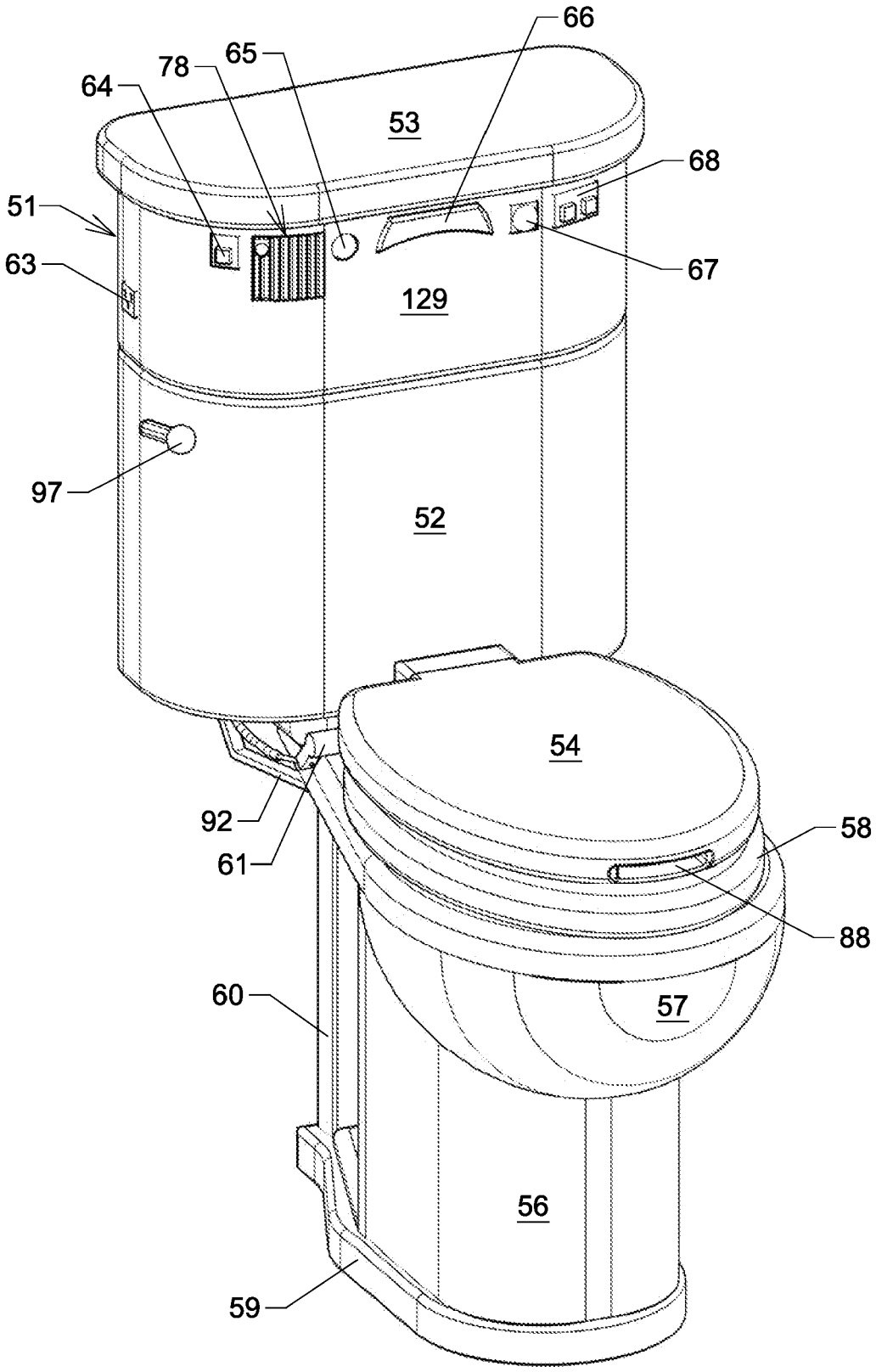
FIG. 2 is a front perspective view of the invention with many of its components installed in a basic configuration as mounted on an average toilet, with the seat lid down illustrating the unit in a normal, inactive state.
Figure 3:
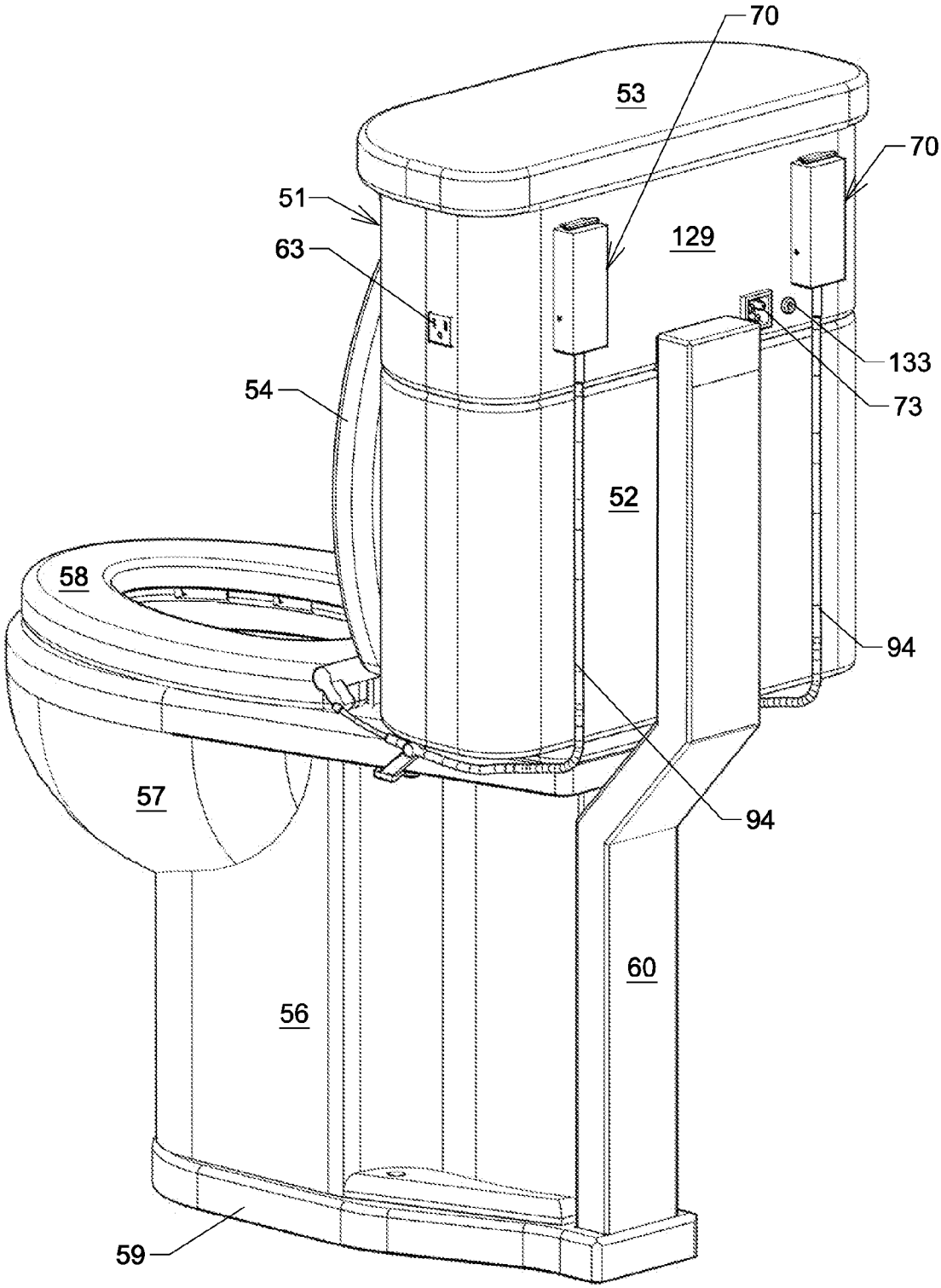
FIG. 3 is a rear perspective view of the invention with many of its components installed in a basic configuration on an average toilet.
Figure 6:
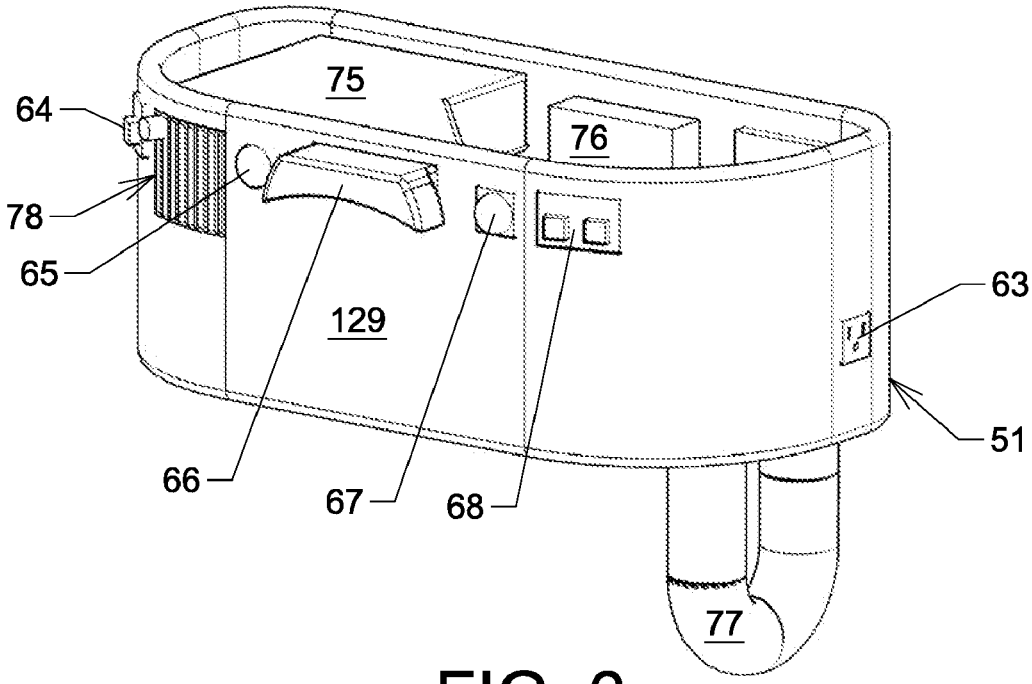
FIG. 6 is a front perspective view of the modular case.
Figure 7:
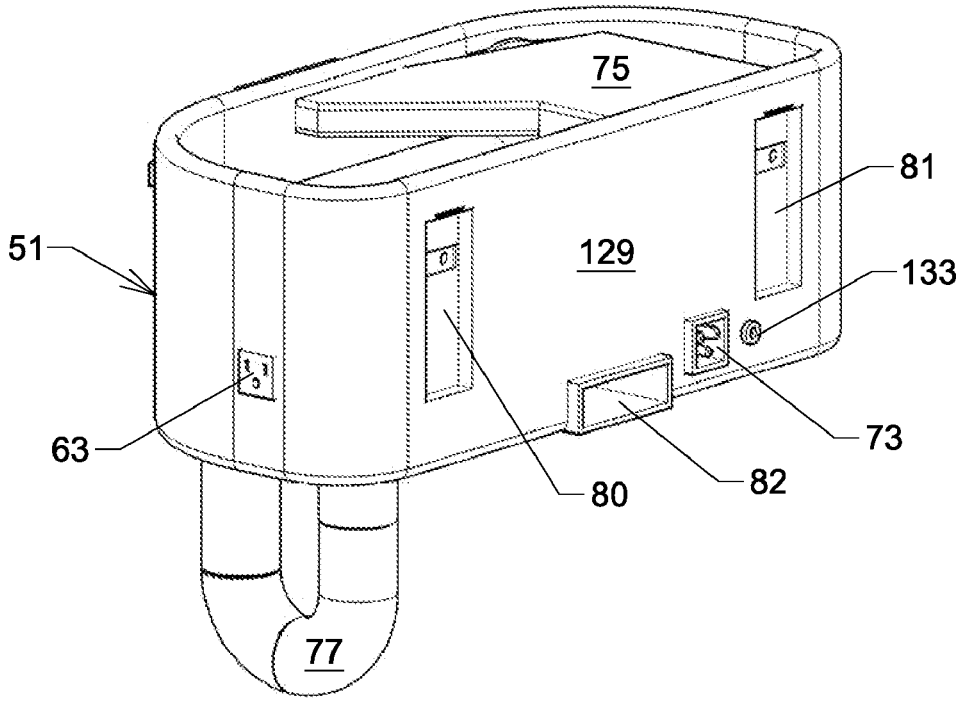
FIG. 7 is a rear perspective view of the modular case.
Figure 8:
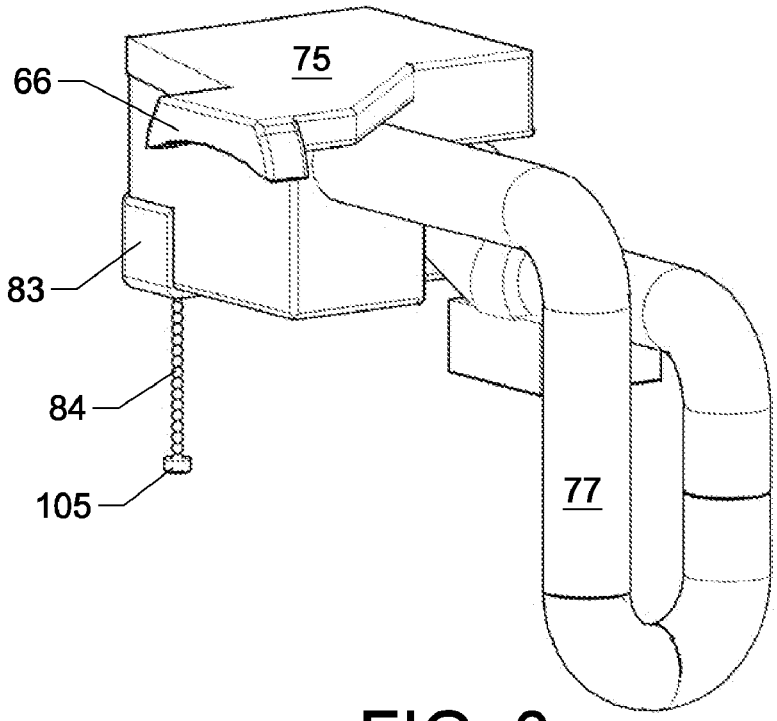
FIG. 8 is a front perspective view of the contents of the modular case to illustrate the details of the ductwork and components inside.
Figure 9:
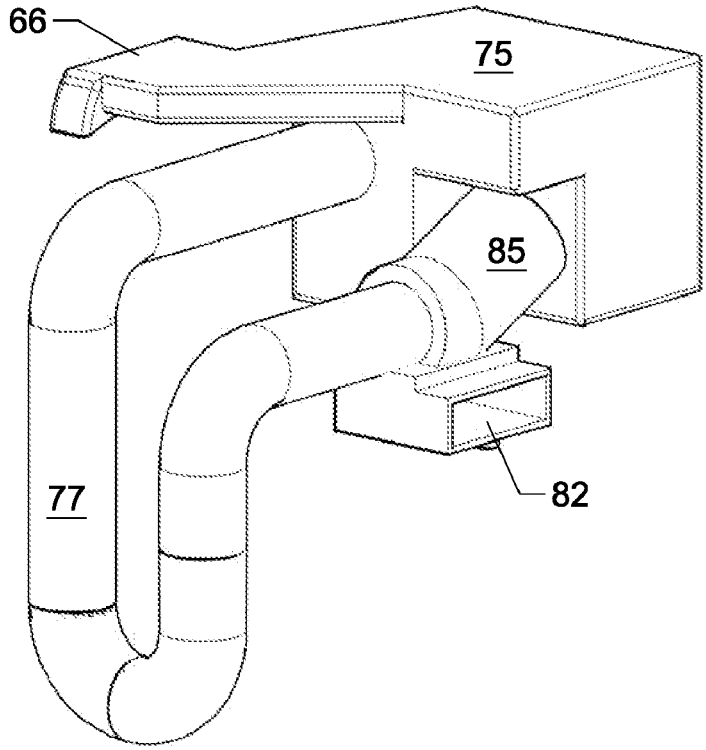
FIG. 9 is a rear perspective view of the contents of the modular case to illustrate the details of the ductwork and components inside.

Modular Case Invention:

The heart of this invention is incorporated a special multifunction modular case assembly 51, depicted in FIG. 1 with the seat lid 54 raised as though in an active state, as mounted on a standard toilet between the water tank 52 and the stock toilet water tank lid 53. FIG. 2 illustrates a perspective view with the seat lid 54 in a normal, closed position. FIG. 3 illustrates the rear perspective view of the modular case assembly 51 as mounted onto a standard toilet. FIGS. 6 and 7 depicts front and rear views of only the modular case assembly 51. The exterior components of the modular case assembly 51 includes a power switch 64, a proximity sensor 65, a snorkel duct 66, a seat control switch panel 68, motion detector 67, convenience power receptacles 63, a sound generation module assembly 78, a power inlet socket 73, exhaust port 82 and seat motor and clutch assembly sockets 80 and 81. FIG. 3 depicts the seat and seat lid motor assemblies 70 as installed in the backside exterior of the modular case assembly 51. FIGS. 8 and 9 depicts front and rear views of the interior of the modular case assembly 51, with the case skin 129 removed for even more clarity of the parts inside. The interior components of the modular case assembly 51 comprising a vacuum pump 75, a P-Trap 77, a Ball-Trap 85, a mechanical toilet flush actuator 83 with attached flush actuator chain 84 and flush actuator lever magnet 105, an exhaust port 82 and a snorkel duct 66. An electronic control module 76 can be viewed inside the modular case assembly 51 in FIG. 6.

Figure 4:
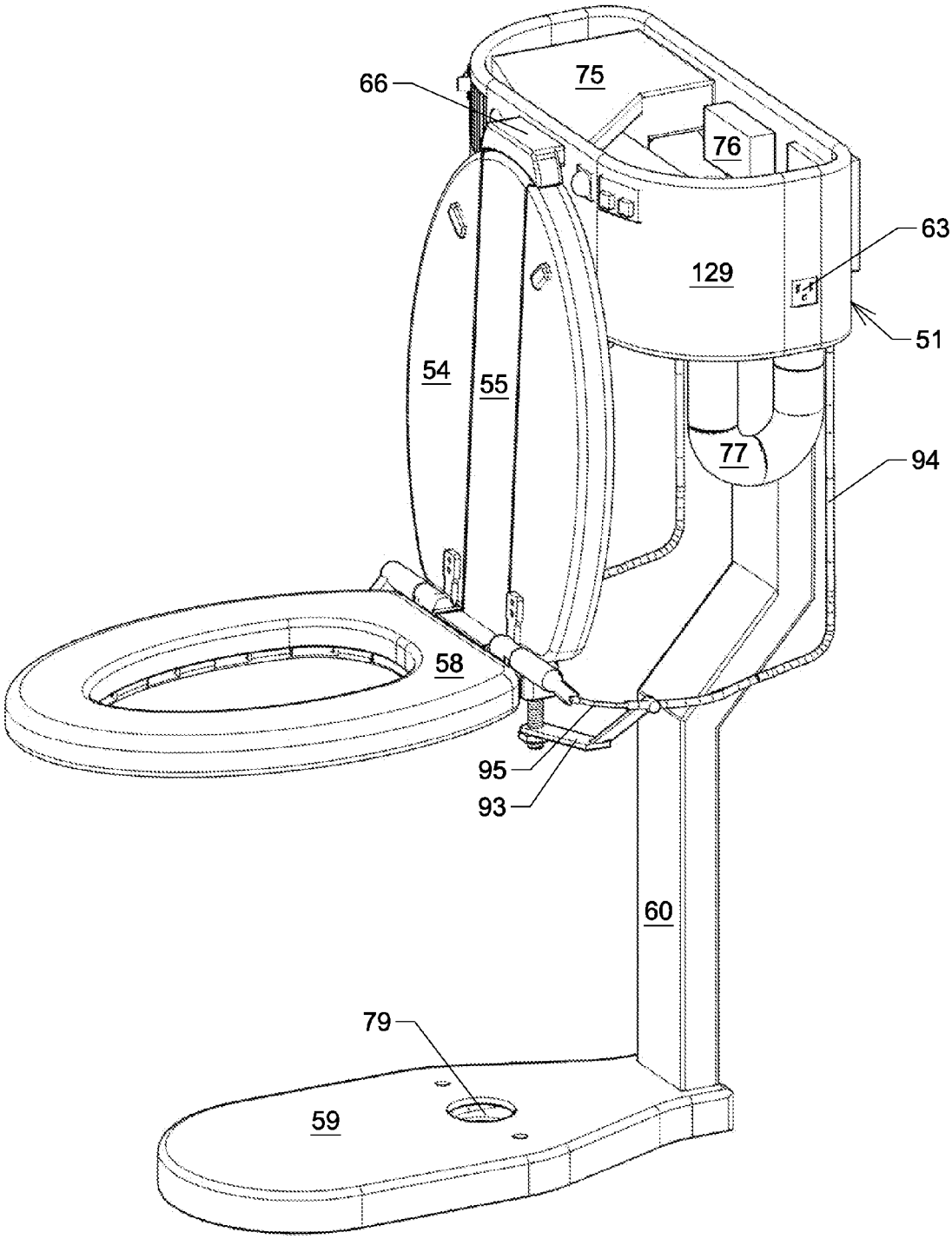
FIG. 4 is the same front perspective view of the invention as shown in FIG. 1 but the toilet bowl and water tank is removed to better illustrate the components of the invention and their interconnections.
Figure 5:
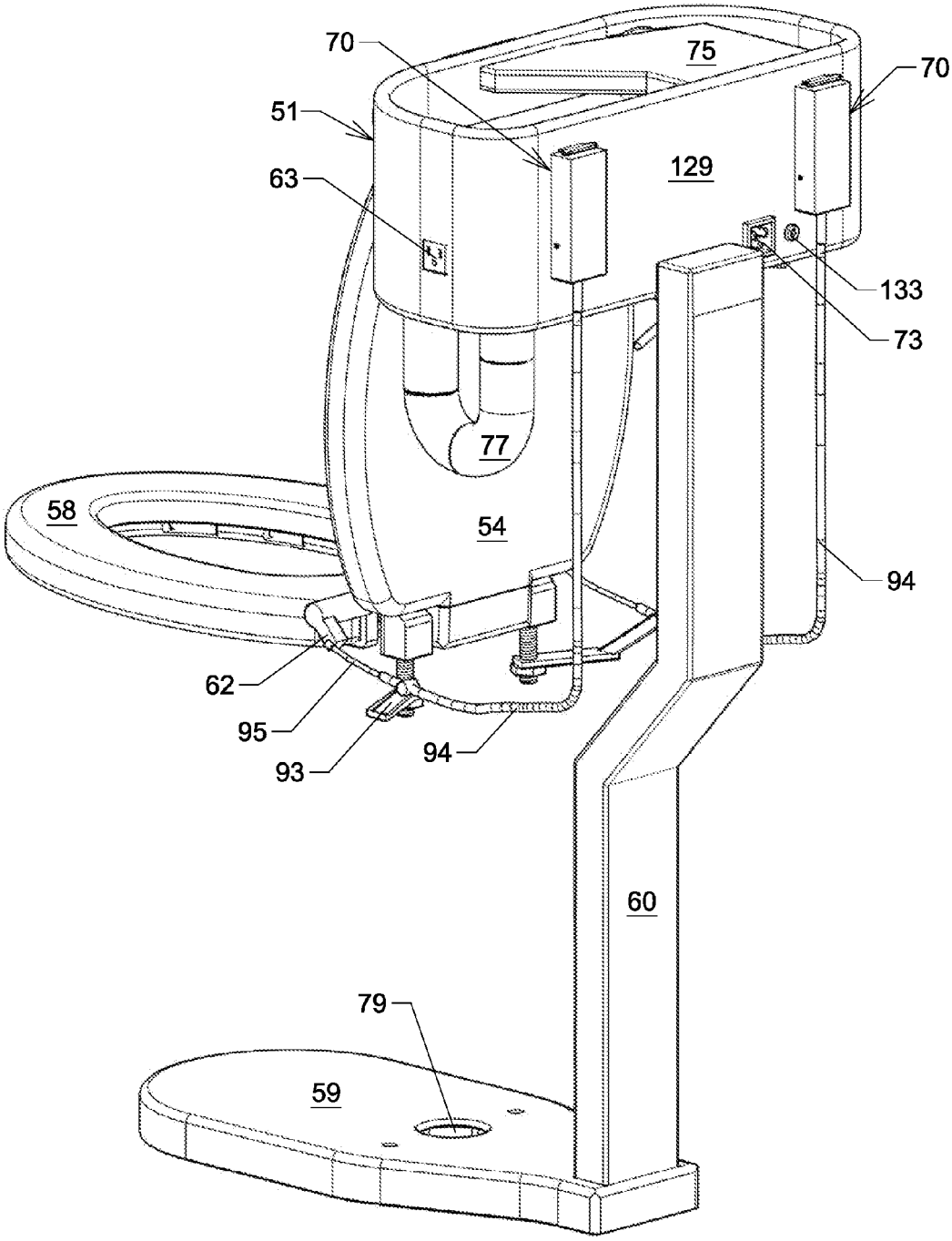
FIG. 5 is the same rear perspective view of the invention as shown in FIG. 3 but the toilet bowl and water tank is removed to better illustrate the components of the invention and their interconnections.
Figure 12:
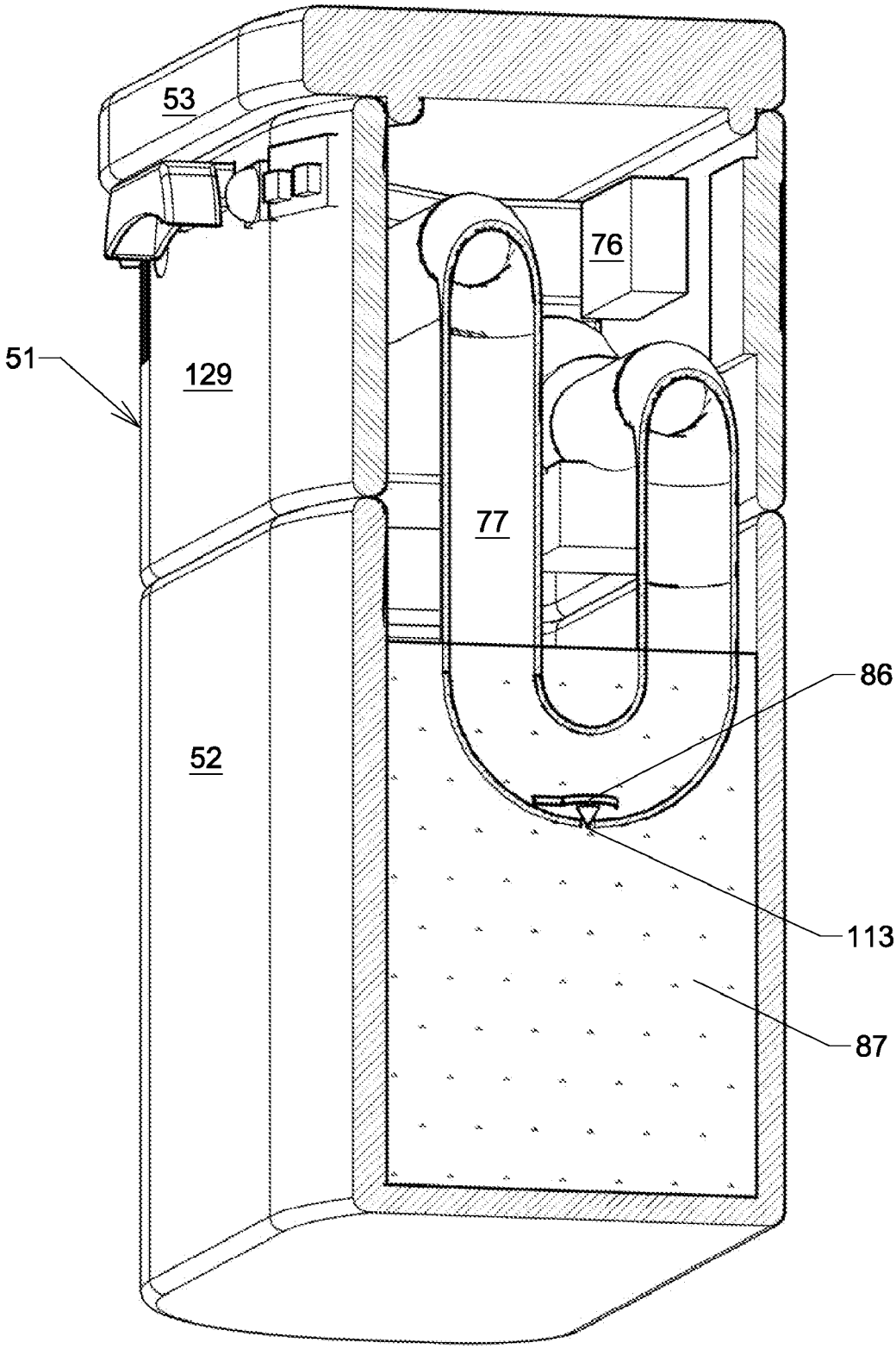
FIG. 12 is a sectional view of the water tank and modular case to illustrate the P-Trap, and how its unique position as protruding down from the modular case gives it the proximity to the water tank's water supply; hence allowing the P-Trap's passageway to be submerged.
Figure 16:
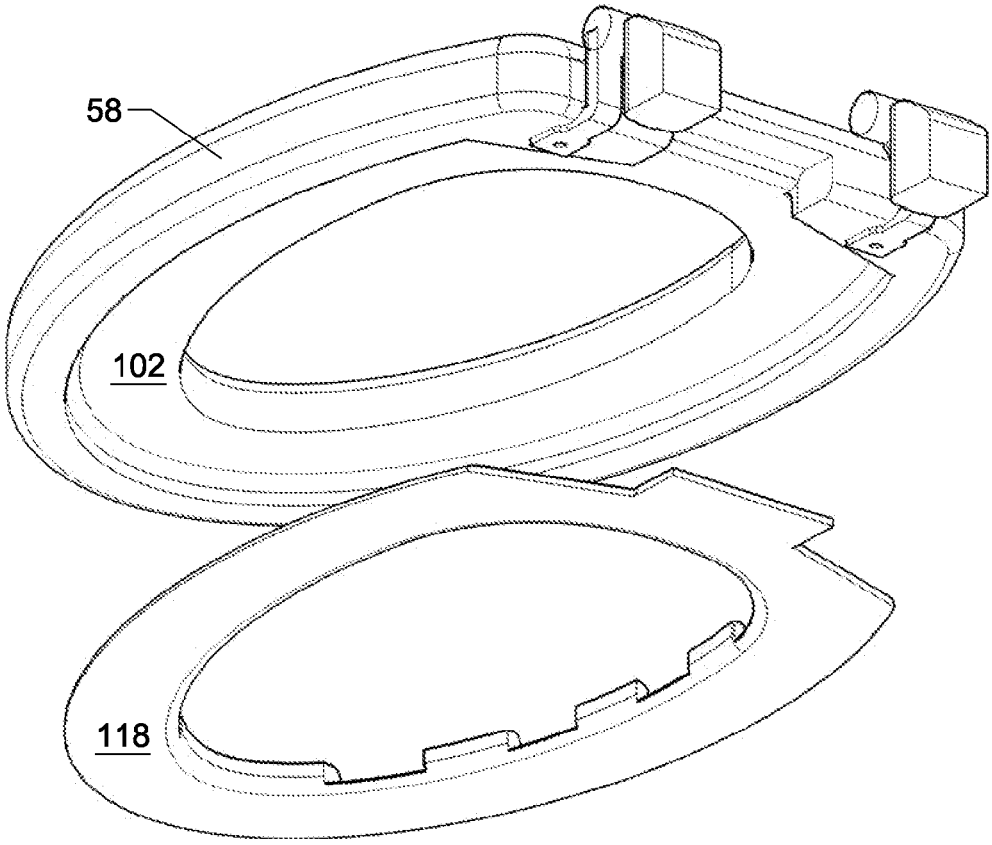
FIG. 16 is the same bottom perspective view of the toilet seat as in FIG. 15, but now illustrates the seat duct cover removed to illustrate its removability and the accessible duct cavity inside.
Figure 17:
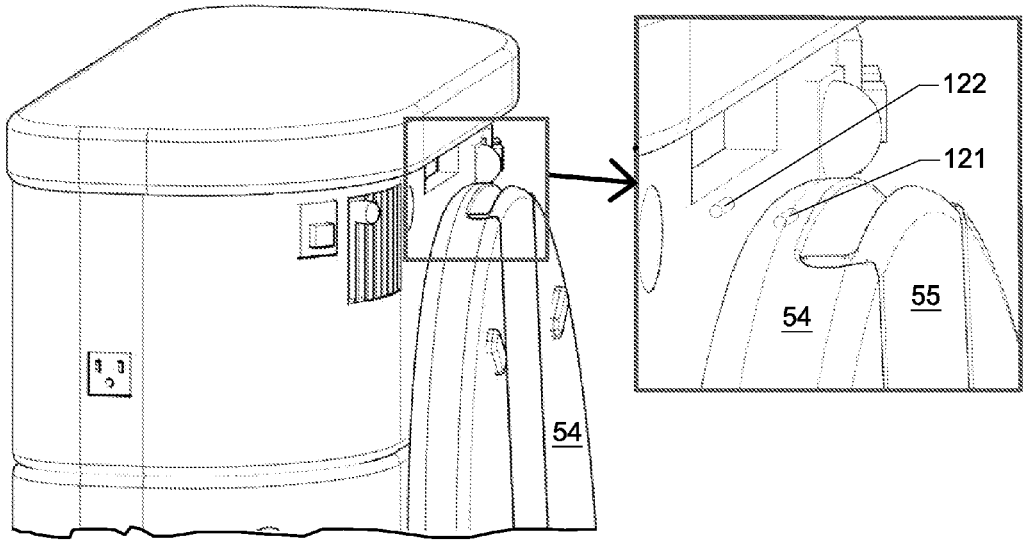
FIG. 17 is a perspective view of the top of the seat lid shown in the open position adjacent to the modular case to illustrate location of the magnetic switch inside the modular case and how the proximity of the magnet inside the top edge of the seat lid can activate it.

Ventilation System Detail:

FIGS. 4 and 5 are front and rear perspective views of the current invention with the stock toilet removed from the drawings to more clearly reveal its components. The toilet ventilator component of this invention comprises: (i) a special toilet seat 58 depicted in FIGS. 15 and 16 and toilet seat lid 54 depicted in FIGS. 13 and 14 that is designed to vent odorous air out of the toilet bowl 57; (ii) FIG. 4 depicts a snorkel duct 66 that protrudes from the modular case assembly 51 to receive air from the seat lid 54 and to deliver it to the interior mounted vacuum pump 75; (iii) a powered vacuum pump 75 for the purpose of creating a vacuum to draw air from the toilet bowl 57 via the seat 58 and seat lid 54 ducting; (iv) a control module 76 containing electronic circuits for automation control; (v) FIG. 17 depicts a seat lid magnet 121 and magnetically actuated switch 122 to signal the activation of the vacuum pump 75 to an electronic control module 76; (vi) FIG. 12 depicts U-shaped gas exhaust duct disposed in the toilet's water tank 52 called a P-Trap 77 which provides sewer gas backflow blockage; (vii) FIG. 9 depicts a Ball-Trap 85 which acts as a backup for said P-Trap 77; (viii) exhaust port 82 that provides an exit for the exhaust path to the posterior of the modular case assembly 51, an exhaust duct 60 depicted in FIG. 5 to deliver the exhaust gas to the exhaust manifold 59; and (ix) a toilet base exhaust manifold 59 a for the purpose of providing an exhaust port into the existing sewer drain system of the building. The entire ductwork passageways are very large to provide the most efficient movement of air through the system.

Figure 10:
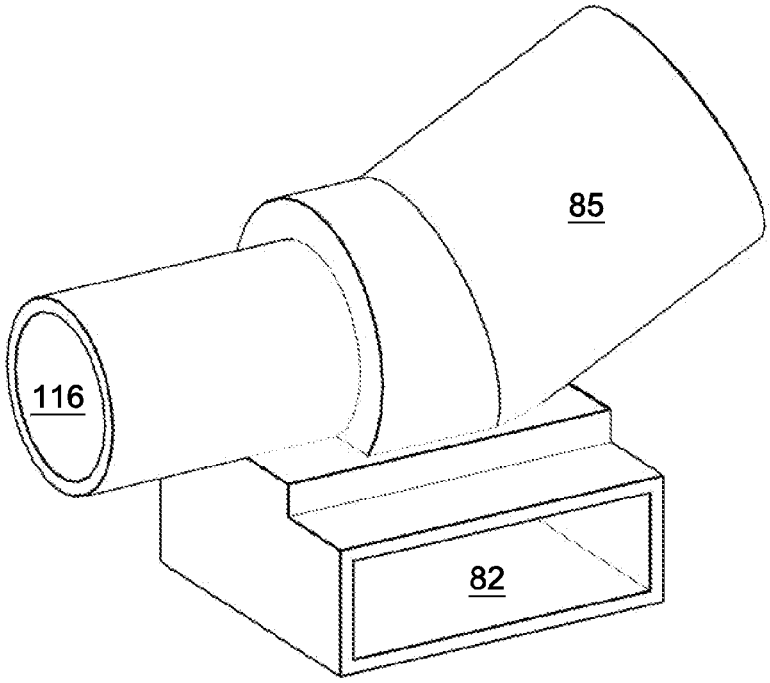
FIG. 10 is a perspective diagram of the Ball-Trap.
Figure 11:
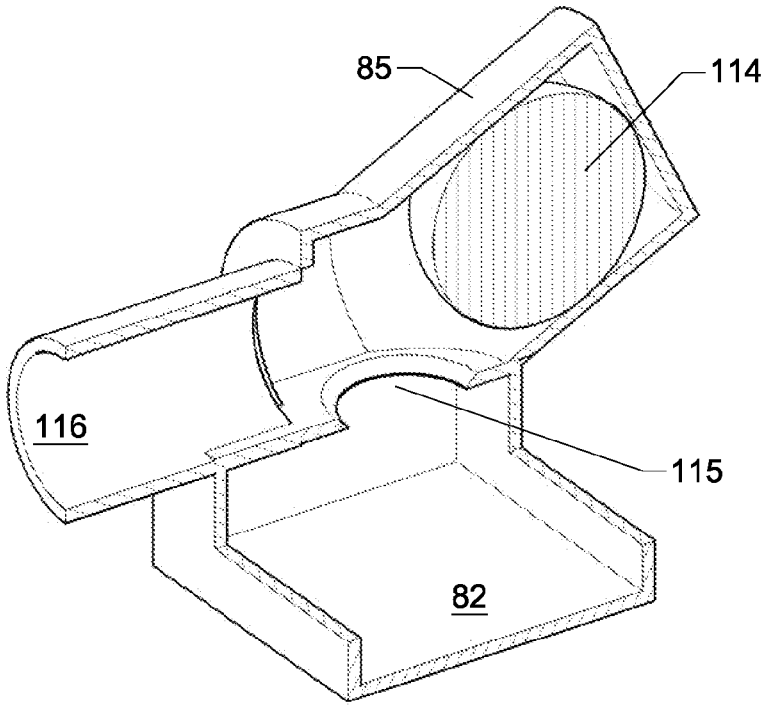
FIG. 11 is a sectional view of the Ball-Trap to show the ball and the orifice that closes off once the ball rolls down onto it after the airflow through the ductwork ceases.
Figure 18:
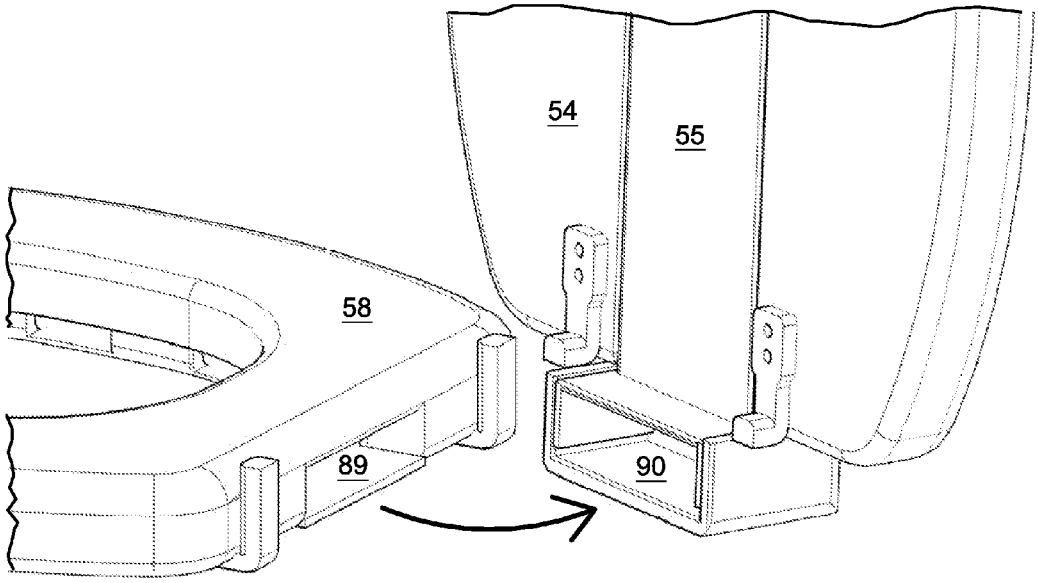
FIG. 18 is a perspective view of just the seat and seat lid with the seat lid slightly cocked out of alignment with the seat to illustrate the mating duct cavities of each part and how these two parts form a unique ductwork joint when the seat lid is in the raised position.
Figure 26:
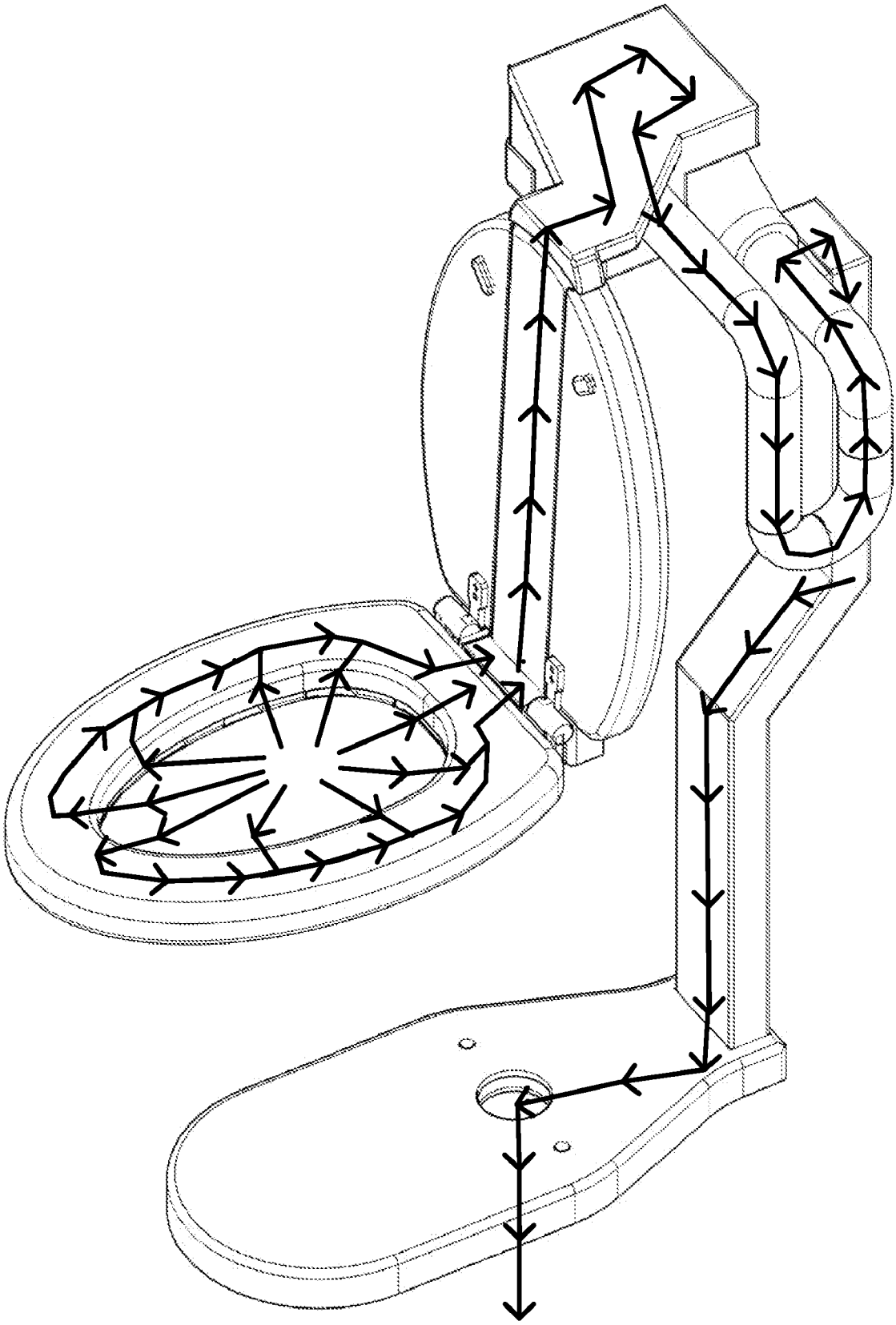
FIG. 26 is a front perspective view of the invention with only the ventilation components shown to illustrate the airflow through the system once the system is activated.
Figure 27:
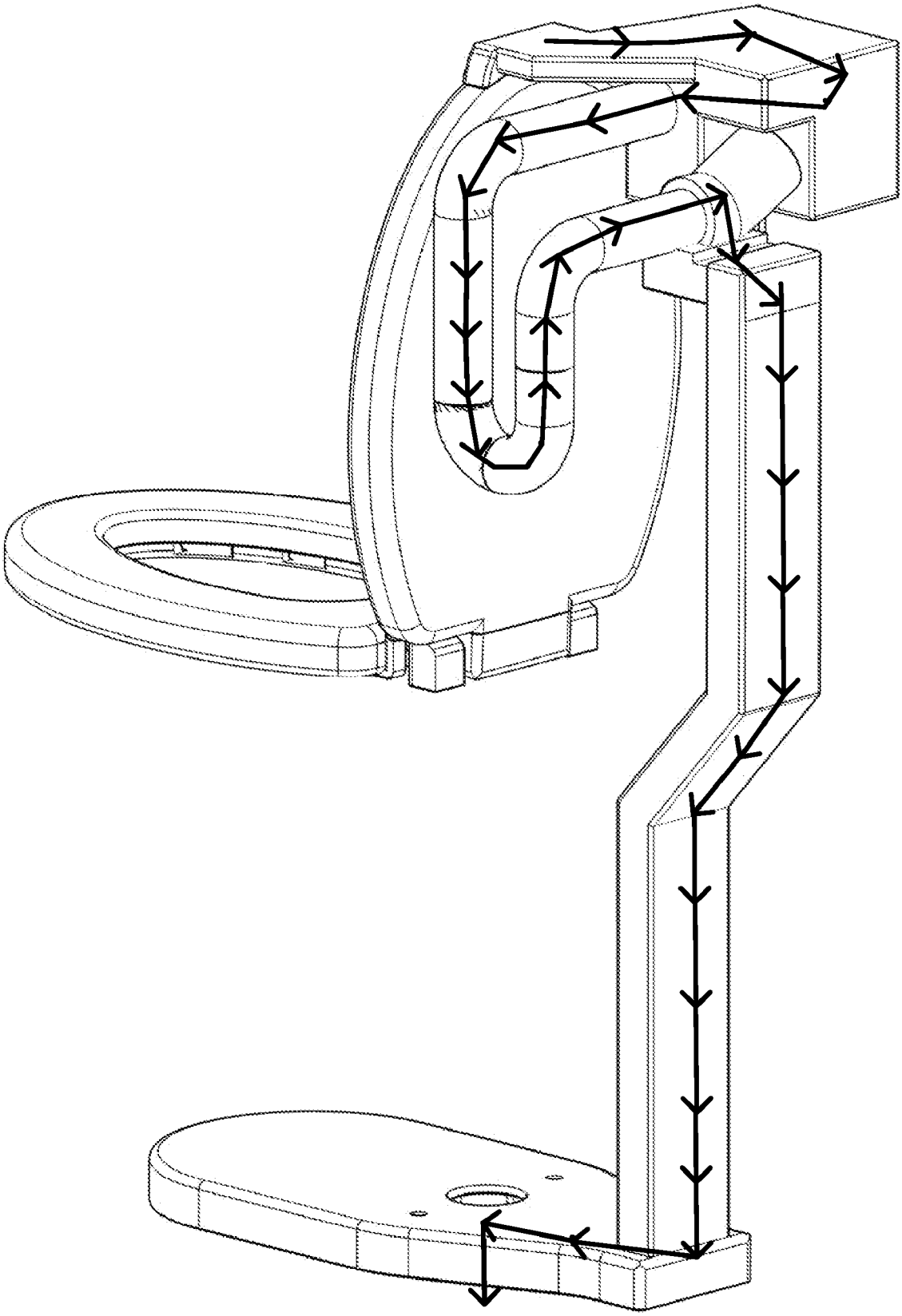
FIG. 27 is a rear perspective view of the invention with only the ventilation components shown to illustrate the airflow through the system once the system is activated.

The toilet ventilating system works as follows: (i) Depicted in FIG. 1, the ventilation system is first activated after the toilet seat lid 54 opens and stops against the modular case assembly 51. Depicted in FIG. 17, once the seat lid 54 is raised, a small magnet 121 that is embedded inside the top edge of the seat lid 54 activates a magnetic switch 122 that is mounted inside the modular case assembly 51; (ii) Once the magnetic switch 122 becomes activated, it will signal the electronic control module 76 to then activate the vacuum pump 75; (iii) Once the vacuum pump 75 is activated, a vacuum is created in the installed toilet bowl 57 area ductwork in the toilet seat 58; (iv) The system draws odorous air directly away from the toilet bowl 57 before it can escape by incorporating a modified toilet seat 58 and seat lid 54 depicted in FIGS. 13 and 15 which form the ventilation ducting from the toilet bowl 57 area. Air is first drawn directly from the toil bowl 57 via duct orifices 101 that circumferences the bottom inside rim of the toilet seat 58 into a cavity 102 inside the toilet seat 58 shown in FIGS. 15 and 16; (v) the exhausted air then communicates with a unique seat lid duct cavity 104 inside the toilet seat lid 54 via a duct joint that is formed when the seat duct joint 89 of the toilet seat 58 perfectly mates with the matching seat lid duct joint 90 located at the bottom end of the open toilet seat lid 54. FIG. 18 clarifies this special joint, 89 and 90 by slightly cocking the drawing of the seat lid 54 to expose the mating area; (vi) the exhausted then air moves through the seat lid duct cavity 104 that is shaped inside the toilet seat lid 54 to a seat lid snorkel joint 88 at the top end of the open seat lid 54, depicted in FIGS. 13 and 14; (vii) the air then communicates with a mating snorkel duct 66 that protrudes from the water tank 52 mounted modular case assembly 51 and mates with the seat lid snorkel joint 88, where the air then moves through the snorkel duct 66, which forms the beginning ductwork stage inside the modular case assembly 51 that is connected directly to a vacuum pump 75; (viii) Depicted in FIG. 8, the air then enters the vacuum pump 75 and then exits the pump under pressure as it exhausts to a P-Trap 77; (iv) the air then moves into the P-Trap 77 depicted in FIG. 12, which is a U shaped exhaust duct that contains a water valve 86 and orifice 113 at the bottom end of the P-Trap 77 which is a water refilling mechanism. This P-Trap 77 assembly is specially mounted in the modular case assembly 51 so that its ducting can be disposed down inside the toilet's water tank 52 far enough that it becomes submerged into the water 87 contained inside the water tank 52 to prevent sewer gas backflow. The air under pressure then moves through this submerged and water filled P-Trap 77 duct and completely blows the water inside the duct down the ductwork in the process; (x) the air and small amount of water then moves out of the P-Trap duct 116 into a Ball-Trap 85, which is simply a ball 114 that rests on a duct orifice 115 by gravity and is designed as a check-valve while the system is deactivated as a backup to the P-Trap 77 to seal off sewer gas backflow. FIGS. 10 and 11 illustrate the components of the Ball-Trap 85. The air pressure moves the ball 114 up and away from the orifice 115, thereby opening a ductwork path through the Ball-Trap 85; (xi) the air then passes to the outside of the modular case assembly 51 from an exhaust port 82 that is mounted between the Ball-Trap 85 and the posterior side of the modular case assembly 51; (xii) the air then travels down an exhaust duct 60 that communicates with the exhaust manifold 59 that is mounted under the toilet base 56, depicted in FIG. 3, where the air traverses to exhaust manifold 59 via the exhaust manifold duct joint 117 depicted in FIG. 20; (xiii) the air travels through this exhaust manifold duct joint 117 to an exhaust manifold cavity 103 then moves the air to the toilet sewer orifice 79 where it finally expels the gas into the bathroom's sewer discharge plumbing line and therefore, to the outside environment. FIGS. 26 and 27 illustrate the complete gas pathway from a front and rear perspective.

Figure 13:
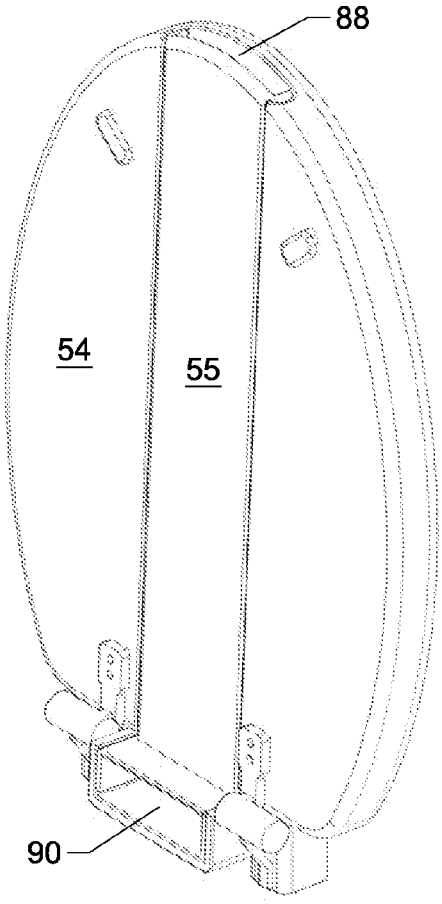
FIG. 13 is a bottom perspective view of the toilet seat lid, which illustrates the seat lid duct cover and the duct openings at both ends of the seat lid.
Figure 14:
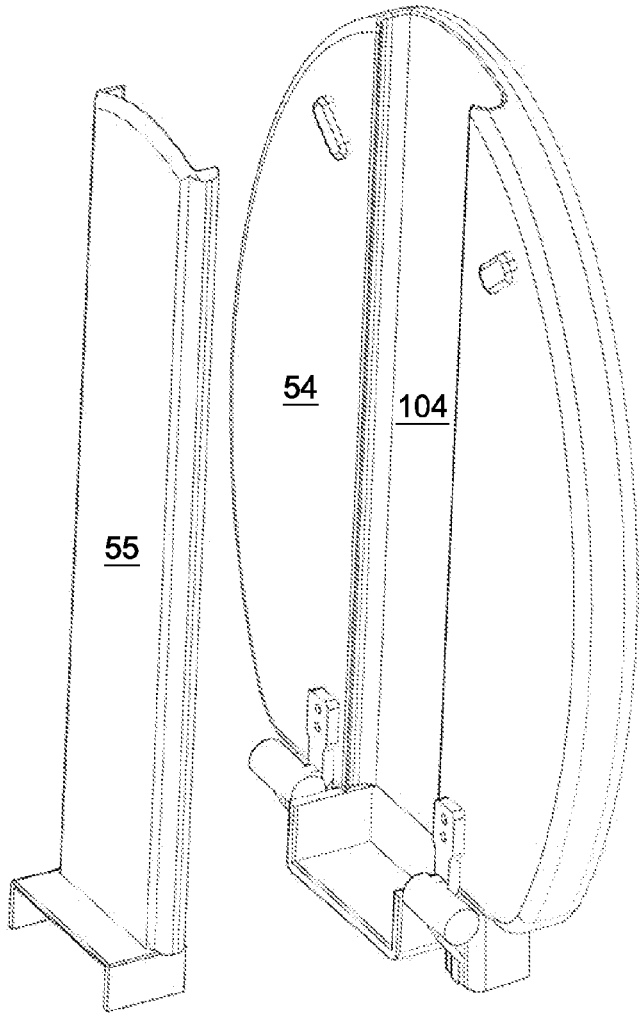
FIG. 14 is the same bottom perspective view of the toilet seat lid as shown in FIG. 13 but now illustrates the duct cover removed from the seat lid to illustrate its removability and the accessible duct cavity inside.
Figure 15:
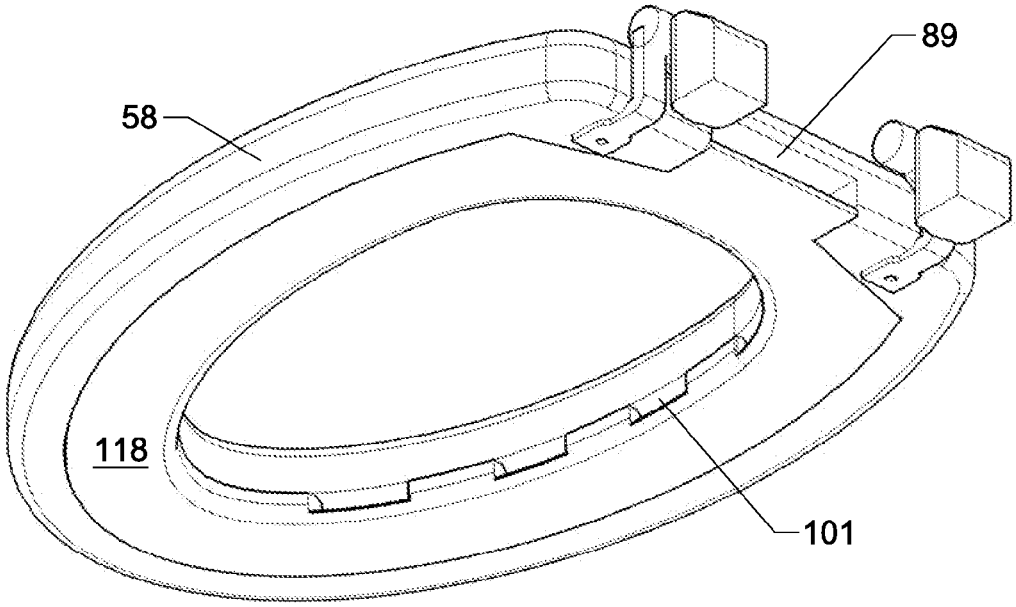
FIG. 15 is a bottom perspective view of the toilet seat, that shows the attached seat duct cover, the orifices along the inside rim of the seat and the duct joint opening at the back edge of the seat.

Toilet Seat and Seat Lid Ducting:

This invention utilizes both the seat 58 and the seat lid 54 to form a unique ductwork channel that enables the collection of air directly from the circumference of the toilet bowl 57 and then provides for its delivery to the snorkel duct 66 from the modular case assembly 51. The seat 58 was designed with a cavity 102 so that it could be used as a duct to pull air directly from the circumference of the toilet bowl 57 through seat duct orifices 101. FIGS. 15 and 16 illustrates the cavity 102 inside the seat 58 as well as the shape and function of the easily removable duct lid 118 for routine cleaning of the duct cavity 102. Air collected from these orifices 101 is pulled to the back end of the seat 58 where it exits the seat duct cavity 102 through a seat cavity joint 89. This seat cavity joint 89 mates perfectly with the seat lid duct joint 90 when the seat lid 54 is open. In FIG. 18, the seat lid 54 as slightly cocked to illustrate the joint that is formed when the seat joint duct 89 mates with the seat lid duct joint 90 to complete a ductwork path into the seat lid 54. Air then is pulled up through the seat lid 54 where a seat lid duct cavity 104 exists to provide the ductwork to communicate the air to the snorkel joint 88 located at the top edge of the seat lid 54. The air then exits the duct joint 88 and enters the snorkel duct 66. FIGS. 13 and 14 illustrates the cavity inside the seat lid 54 as well as the shape and function of the easily removable seat lid duct lid 55 for routine cleaning of the seat lid duct cavity 104.

Snorkel Duct Design:

Depicted in FIG. 1, the modular case assembly 51 houses a snorkel duct 66 that that is designed to communicate air from the seat lid duct joint 88 at the top edge of the seat lid 54 to the vacuum pump 75 as disposed inside the modular case assembly 51 by perfectly mating with it once the seat lid 54 is raised. A raised seat lid 54 completes the duct pathway from the toilet bowl 57 into and through the seat 58 and then up into and though the raised seat lid 54 where it enters the snorkel duct 66. From there the air continues into the vacuum pump 75. Although the diagram illustrates this snorkel duct 66 as a fixed attachment to the modular case assembly 51, another embodiment of this invention would be to offer a retractable snorkel duct 66, which would automatically extend each time the seat lid 54 is raised and retract when the seat lid 54 is lowered. This would allow the protruding snorkel duct 66 from the modular case assembly 51 to be less noticeable if it was retracted and flush with the modular case assembly 51. FIG. 2 illustrates the snorkel duct 66 in a retracted position.

Vacuum Pump Function:

An important feature of the modular case assembly 51 is to house and disguise a vacuum pump 75 in order to develop the required vacuum to completely remove the odorous air from the toilet bowl 57 and deliver it through the various modular ductwork options to be removed from the bathroom by vents or by air filtration. The vacuum pump automatically activates and deactivates by an electronic control module 76 which receives a signal from a magnetically operated switch 122 in the modular case assembly 51 that activates with a magnet 121 inside the seat lid 54 when it is raised or lowered, depicted in FIG. 17.

P-Trap Design and Function:

A preferred embodiment of this invention uses an optional exhaust manifold 59 to purge the toilet bowl 57 air directly into the sewer drain. However, this method of tapping into the sewer drain requires a protection device that prevents the sewer gases from exiting the sewer and entering the ventilation system and bathroom. Thus, this invention has incorporated the use of an industry standard and code approved P-Trap 77, which is a U shaped pipe that is normally filled with water to establish a gas barrier, depicted in FIG. 12. The current invention uses such a device inside the modular case assembly 51 where its strategic location allows it to utilize the water tank's water 87 supply to submerge it, thereby sealing off sewer gas from entering the bathroom. The P-Trap 77 utilizes a small water valve 86 and orifice 113 as a filling mechanism for the P-Trap 77. Normal pressure from the water 87 in the water tank 52 pushes the small water valve 86 up from the orifice 113 allowing water 87 to flood into and fill the P-Trap 77 to the level of the water tank 52. The valve 86 will simply float up in the water 87, leaving the orifice 113 open. Once the vacuum pump 75 becomes activated, air pressure will force all of the water in the P-Trap 77 out to the exhaust manifold 59, where is will be deposited into the sewer drain. Under the air pressure inside the P-Trap 77, the valve 86 will be forced down, where it will seal against the orifice 86 to prevent more water 87 from entering while the vacuum pump 75 is running. Note that the air pressure alone would prevent more water 87 from entering the P-Trap 77, however, a valve 86 that opens and closes is designed to keep the orifice 113 clean and functional. Once the air pressure stops, the valve 86 no longer has a force on it to keep it closed, so it floats up under water pressure as the water 87 again submerges the P-Trap 77 cavity.

Ball-Trap Design and Function:

Depicted in FIGS. 10 and 11, a Ball-Trap 85 is a backup mechanism to the P-Trap 77 should the P-Trap 77 fail as may be the case if the building loses water pressure and then the toilet gets flushed. If the toilet's water tank 52 is then unable to refill to its normal level, then the P-Trap 77 refilling mechanism would not have water to refill it. Therefore, as a backup for this rare situation, a Ball-Trap 85 was designed to still keep sewer gases from escaping into the bathroom. This device works by using a ball 114 that normally rests by gravity on an orifice 115 with enough pressure to adequately act as a gas seal. Once the vacuum pump 75 creates an air pressure inside the Ball-Trap 85, the ball 114 will rise up away from the orifice 115 where the air can then proceed past the ball 114 to the exhaust port 82. Once the vacuum pump 75 stops, the ball 114 will roll back down by gravity to again cover and seal the Ball-Trap orifice 115.

Figure 19:
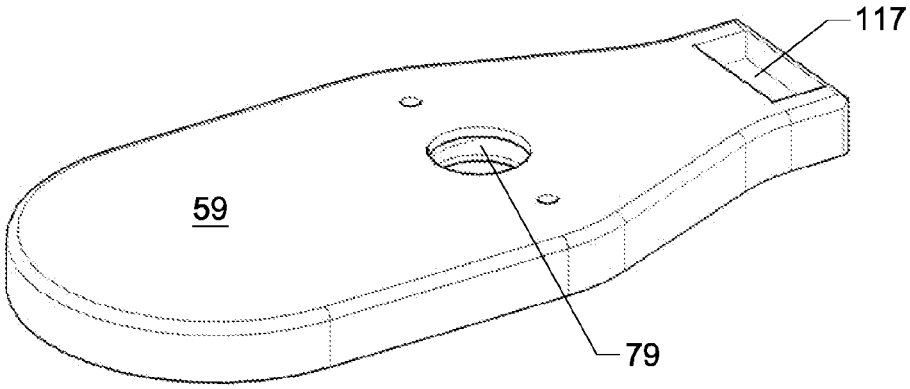
FIG. 19 is a top perspective view of the exhaust manifold which illustrates the toilet sewer drain opening and the exhaust duct joint opening.
Figure 20:
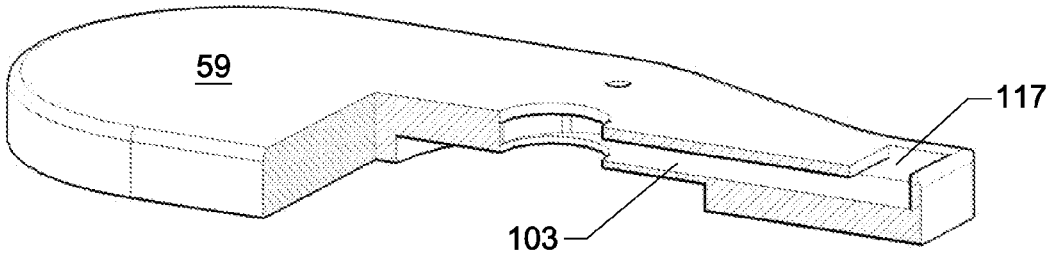
FIG. 20 is a perspective view of the exhaust manifold as in FIG. 19 but with a cutout section that better illustrates the duct cavity that is formed inside the exhaust manifold that links the exhaust duct opening joint to the sewer drain opening.
Figure 21:
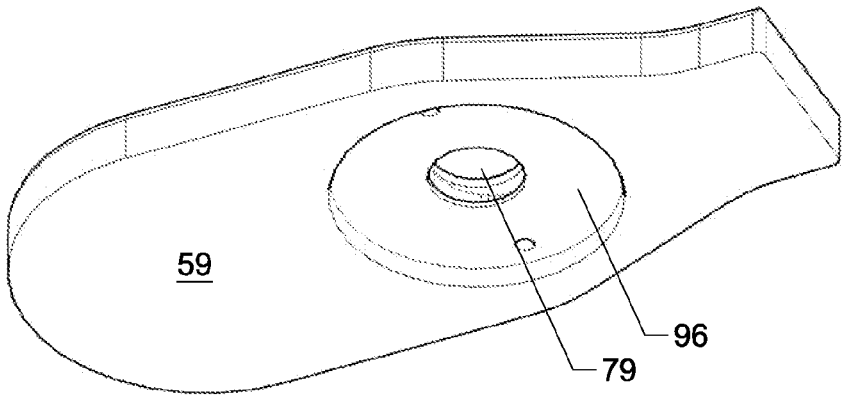
FIG. 21 is a bottom perspective view of the exhaust manifold, illustrating the toilet sewer passageway as well as the cavity that is reserved for a wax seal to be inserted between the manifold and the sewer drain opening in the floor.

Exhaust Manifold Design and Function:

FIGS. 19, 20 and 21 illustrates the exhaust manifold 59 which is a device that allows ducting access to the bathroom's sewer drain plumbing. This device allows for a convenient place to tap into the sewer drain to exhaust the odorous air from the bathroom. Air enters from the top back manifold joint 117 and travels through the manifold exhaust cavity 103 to the toilet sewer orifice 79 where it then discharges down into the sewer drain below the bathroom floor. A wax seal cavity 96 is provided to allow the attachment of a standard wax seal that seals the exhaust manifold 59 to the sewer drain on the bathroom floor.

Figure 23:
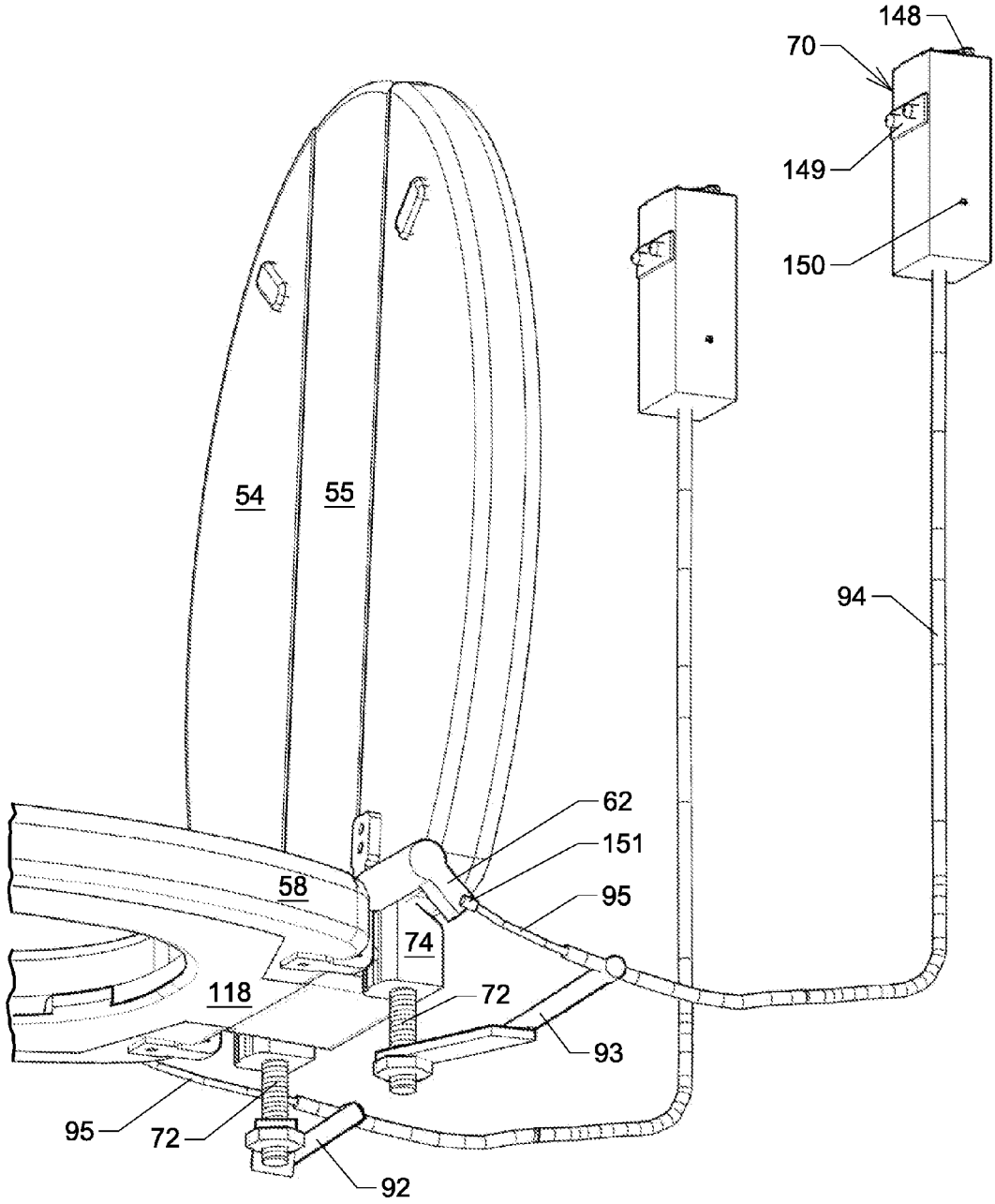
FIG. 23 is a lower perspective view of the invention with the toilet and modular case removed to illustrate the motorized toilet seat raising and lowering apparatus.

Toilet Seat and Seat Lid Motion Control Function:

FIG. 23 is a lower perspective view of the seat lid 54 and seat 58 motion control apparatus. The automatic seat lid 54 and seat 58 motion control of this invention is achieved by using a mechanism that functions simply as a linear actuator.

The toilet seat lid 54 motion is achieved when the motor and clutch assembly 70 extends or retracts a semi-rigid actuator rod 95 that slides inside a guide tube 94 that extends from the motor and clutch assembly 70 to a seat lid hinge lever 61, depicted in FIG. 1, that is mounted rigidly to the seat lid 54. The guide tube 94 is solidly mounted in the motor and clutch assembly 70 case as well as is immobilized by a support bracket 92 mounted on the toilet base 56 by utilizing the same fastener bolts 72 from the seat lid 54. This bracket provides a rigid support from which the motor and clutch assembly 70 exerts the force necessary to raise and lower the seat lid 54. When the actuator rod 95 extends, it pushes on the seat lid hinge lever 61 which pivots the toilet seat lid 54 up. When the actuator rod 95 retracts, the seat lid hinge lever 61 is pulled back thus lowering the seat lid.

Likewise, the toilet seat 58 motion is achieved when the motor and clutch assembly 70 extends or retracts a semi-rigid actuator rod 95 that slides inside a guide tube 94 that extends from the motor and clutch assembly 70 to a seat hinge lever 62 that is mounted rigidly to the seat 58. The guide tube 94 is solidly mounted in the motor and clutch assembly 70 case as well as is immobilized by a support bracket 93 mounted on the toilet base 56 by utilizing the same fasteners from the seat 58. This bracket provides a rigid support from which the motor and clutch assembly 70 exerts the force necessary to raise and lower the seat 58. When the actuator rod 95 extends, it pushes on the seat hinge lever 62 which pivots the toilet seat 58 up. When the actuator rod 95 retracts, the seat hinge lever 62 is pulled back thus lowering the seat.

Figure 24:
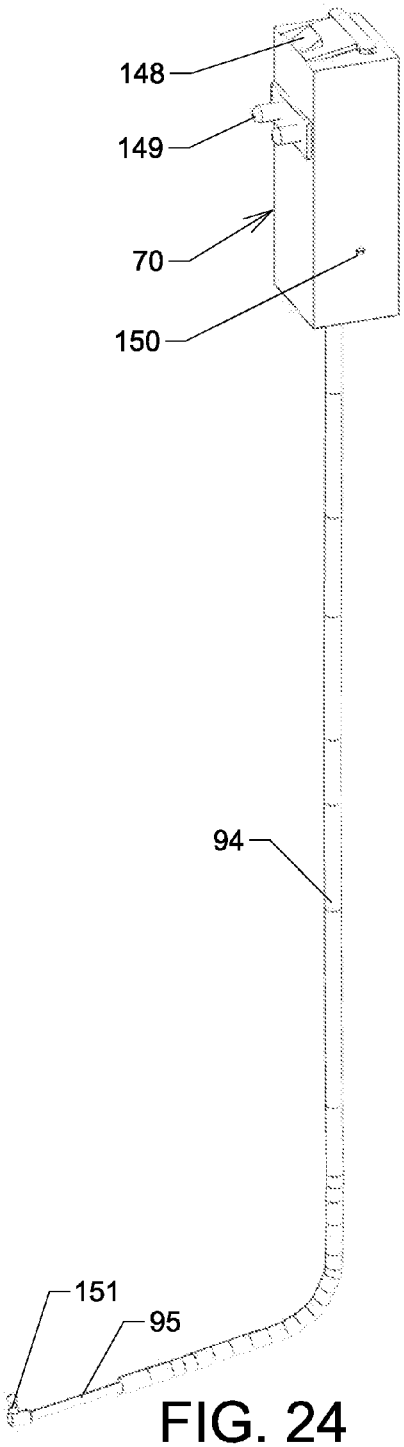
FIG. 24 is a perspective view of the motor and clutch assembly with the actuator guide tube, linear actuator rod and quick disconnect fitting.

The nature of the linear movement of the actuator rods 95 to transfer force down the added length of the actuator guide tubes 94 allow the motor assemblies 70 to be remotely installed. This distances them from the hostility of the toilet bowl 57 environment and keeps them out of view for aesthetics. It also allows them to be easily mounted and electrically connected to the modular case assembly 51. Depicted in FIG. 7, the seat and lid motor assemblies 70 are strategically placed in special sockets 80 and 81 designed for them on the backside surface of the modular case assembly 51. These motor sockets 80 and 81 also contain electrical connectors that mates with a receiving motor electrical terminals 149 in the motor assemblies 70, depicted in FIG. 24. Snapping these motor assemblies 70 inside the sockets 80 and 81 with latch 148 both instantly completes an electrical circuit as well as provides a supporting structure for the motor assemblies 70. The socket 80 and 81 contacts are connected inside the modular case assembly 51 to the electronic control module 76 that is programmed for automatic operation. A switch panel 68 and proximity sensor 65 located on the front of the modular case assembly 51 allows for manual and automatic motor control.

Figure 25:
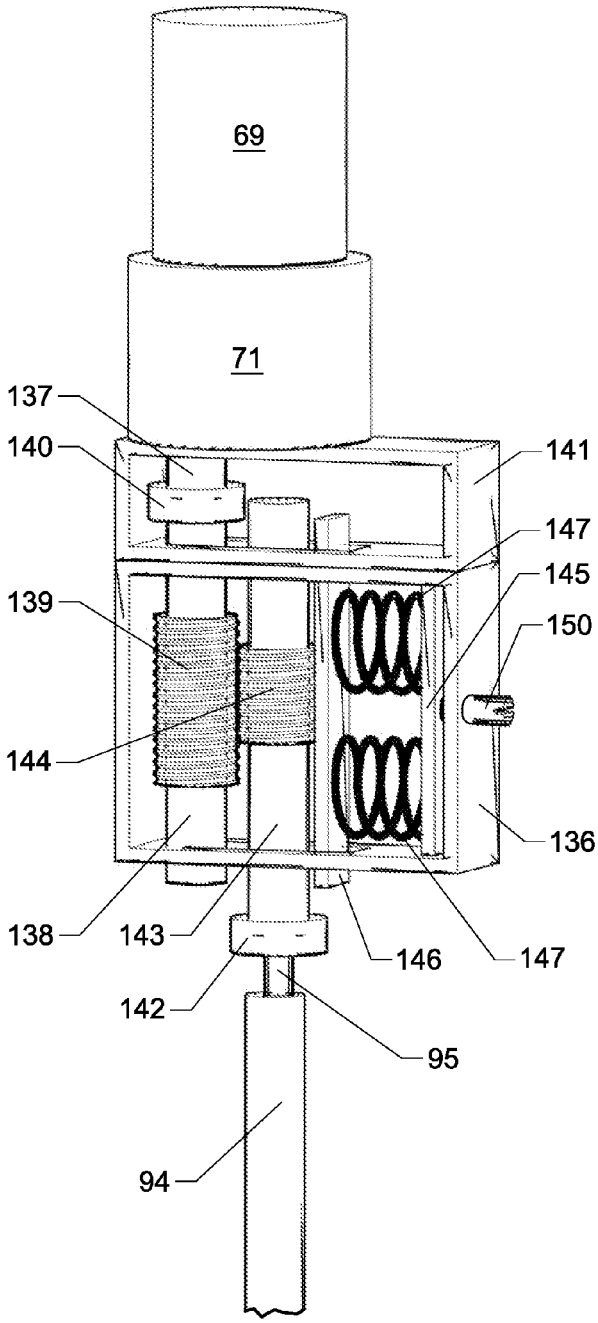
FIG. 25 is a side perspective view of the motor and clutch assembly with its housing removed to display its internal components.

Illustrated in FIG. 25, the motor and clutch assembly 70 has a built in clutch mechanism that allow the motor actuator rod 95 to slip or give if necessary, which would allow the seat lid 54 and seat 58 to be manually moved without the motor gears impeding their movement. Depicted in FIG. 25, the housing for the motor and clutch assembly 70 is removed to illustrate its internal components. The motor 69 turns the gearbox 71 to decrease the motor speed and to increase torque. The gearbox shaft 137 is coupled to an output drive clutch shaft 138 that has output drive clutch threads 139. These threads 139 engage the linear actuator clutch threads 144 which is part of the linear actuator clutch shaft 143. Pressure is exerted from springs 147 that force pressure plate 146 against the linear actuator clutch threads 144 which in turn force the linear actuator clutch threads 144 against the output drive clutch threads 139. Therefore, turning output drive clutch shaft 138 causes linear actuator clutch shaft 143 to turn which then causes actuator rod 95 to linearly move inside guide tube 94. This shaft coupling method allows motor assembly 70 to have a clutch function where the two shafts 138 and 143 can slip if the actuator rod 95 has enough external force applied to it, as would be the case if the seat 58 or seat lid 54 was manually opened or closed. A tension screw 150 could be used to adjust the desired slipping force. To increase the slipping force, the tension screw 150 is screwed in which will move the tension back plate 145 into the springs 147 that will cause the springs 147 to become more compressed and hence apply more force to keep the shaft threads 144 and 139 together.

Figure 22:
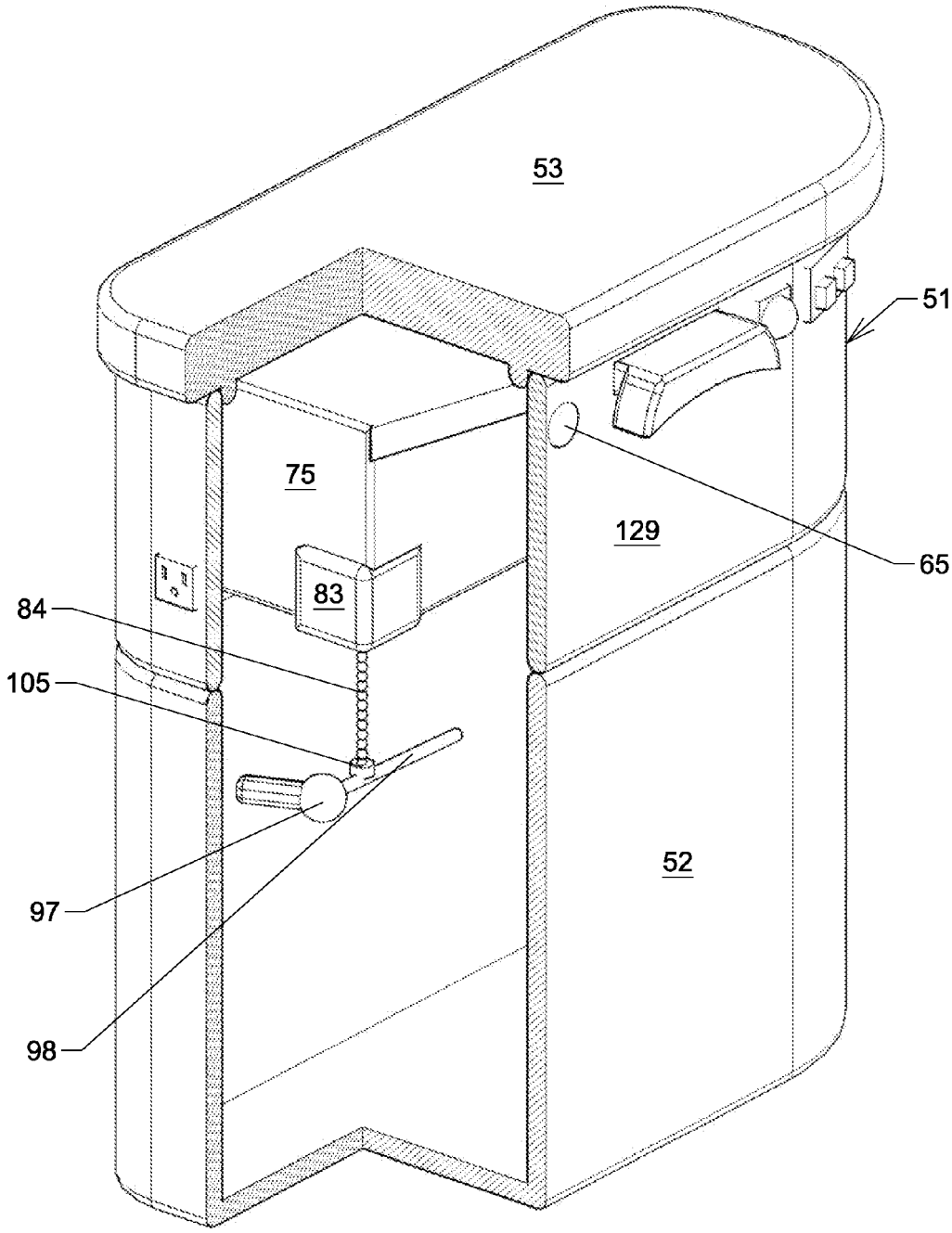
FIG. 22 is a sectional view of the toilet water tank and modular case to reveal the details and positioning of the automatic flush mechanism and its connection to the flush handle actuator lever.

Flush Control Design and Function:

Another feature of the modular case assembly 51 is to provide the mounting structure for yet another automation device that enables the flushing of the toilet after use. The unique position of the modular case assembly 51 allows easy access to the flushing handle lever inside the water tank 52. FIG. 22 shows the modular case assembly 51 with an open cross-section to illustrate the flushing apparatus 83. By attaching an actuator 83, such as a solenoid, and connecting this actuator via an actuator chain 84 or other force transmitting device to the flush handle actuator lever 98 using a magnet 105 or similar coupling device, the system can perform a toilet flush. This system becomes automatic with the addition of a proximity sensor 65. The modular case assembly 51 is designed to accommodate a proximity sensor 65, which will detect that someone is using the toilet. Once the proximity sensor 65 senses the use of the toilet and then detects that the person has left, the flush device will activate, which will pull up on the plunger chain 84 thus automatically flushing the toilet.

Proximity Sensor Utilization:

Depicted in FIG. 1, the modular case assembly 51 provides a front panel placement for a proximity sensor 65. A proximity sensor 65 is used to determine the occupancy of the toilet so that some of the modular case's automatic functions may be performed. Once the device is activated by the close proximity of a person, a signal is relayed to the electronic control module 76. The control module 76 will then wait until the proximity sensor 65 becomes deactivated, signaling that the person has left the toilet. The electronic control module 76 will then activate the flush control actuator 83 to flush the toilet and then activate the seat lid 54 and seat 58 motor controls to lower them.

Figure 41:
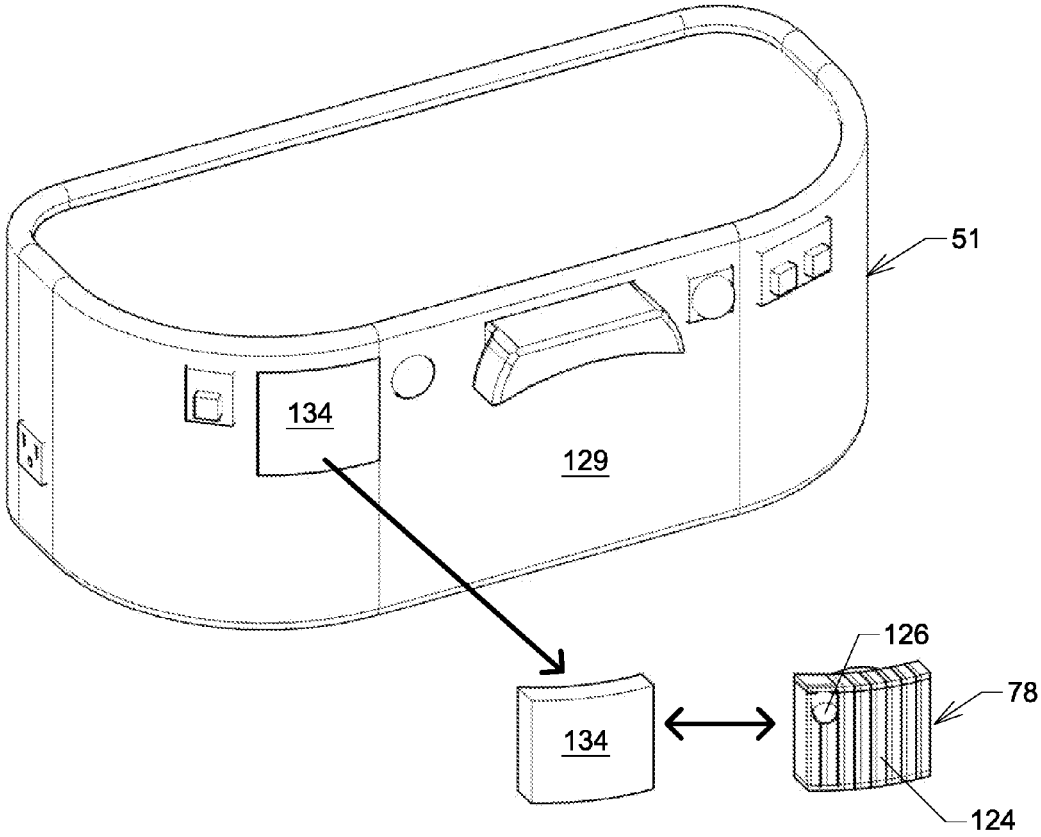
FIG. 41 is a front perspective view of the modular case showing a blank panel that can be removed and replaced with a sound generation module.
Figure 42:
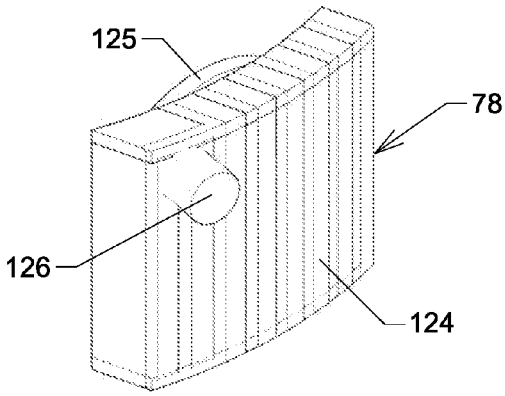
FIG. 42 is a front perspective view of the sound generation module.
Figure 43:
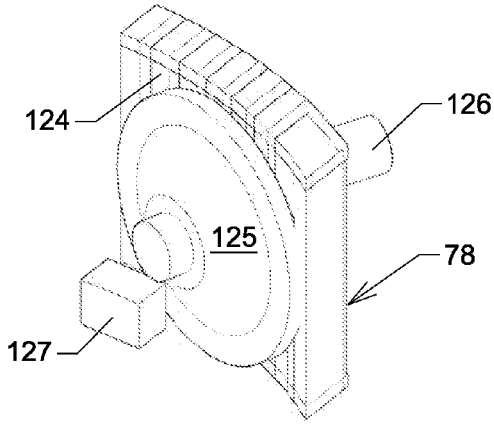
FIG. 43 is a rear perspective view of the sound module that shows the speaker and electronic amplifier module.

Sound Generation Device:

Depicted in FIG. 1, another feature of the modular case assembly 51 is to house an optional sound generation module 78 that is intended to produce background sound while the toilet is in use. It is designed to automatically activate once the toilet seat lid 54 is raised. FIG. 41 illustrates a sound module cover 134 mounted in the front panel of the modular case assembly 51 and how it can be removed to be swapped out with a sound generator module assembly 78. FIG. 42 is a front perspective view of the sound generator module. FIG. 43 is a rear perspective view of the sound generator module 78 to show the speaker 125, grill 124 and electronic amplifier module 127. Multifunction control knob 126 rotates to turn the unit on and to adjust the volume. Pushing on this multifunction control knob 126 cycles the device through numerous sound recordings that are stored in the electronic amplifier module 127. This device contains all the circuits to drive the speaker 125 such as the volume control, sound memory storage and amplifier.

Motion Detection Utilization:

Depicted in FIG. 1, another feature of the modular case assembly 51 is to house a motion detector 67 and electrical receptacles 63. The modular case assembly 51 provides space for a motion detector 67 to be disposed on the front exterior of the modular case assembly 51 that is free of interference from the opening and closing of the toilet seat lid 54 and seat 58. This feature allows the detection of motion in the proximity of the toilet and will signal the electronic control module 76 to apply power to the standard electrical receptacles 63. This feature could be used allow a night light to automatically light a dark bathroom once a person walks near the sensor or other some other standard appliance or device to be activated that is plugged into the modular case's electrical receptacles 63 once the detector is tripped. A switch could be added to the modular case assembly 51 that could allow more control of these power receptacles 63 such as control to manually turn them on or off continuously, independent of the motion detector 67.

Figure 29:
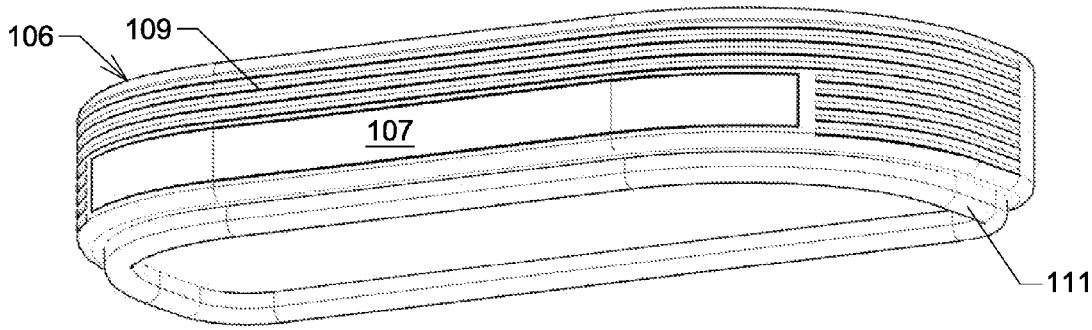
FIG. 29 is a lower front perspective view of the air filtration unit to illustrate its design, the front filter drawer in its normally closed position, the ventilation grills and the unit's mounting guide.
Figure 32:
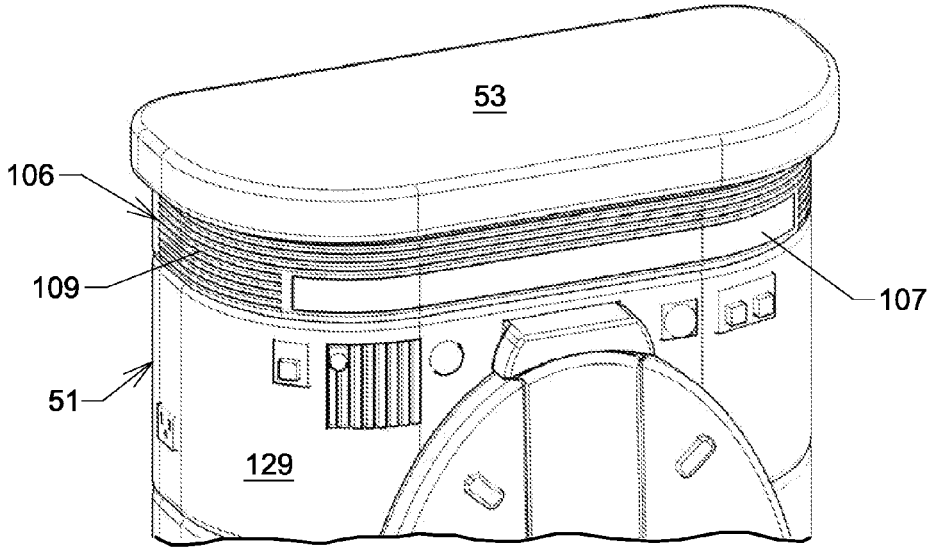
FIG. 32 is a front perspective view of the air filtration unit as attached to the modular case.
Figure 33:
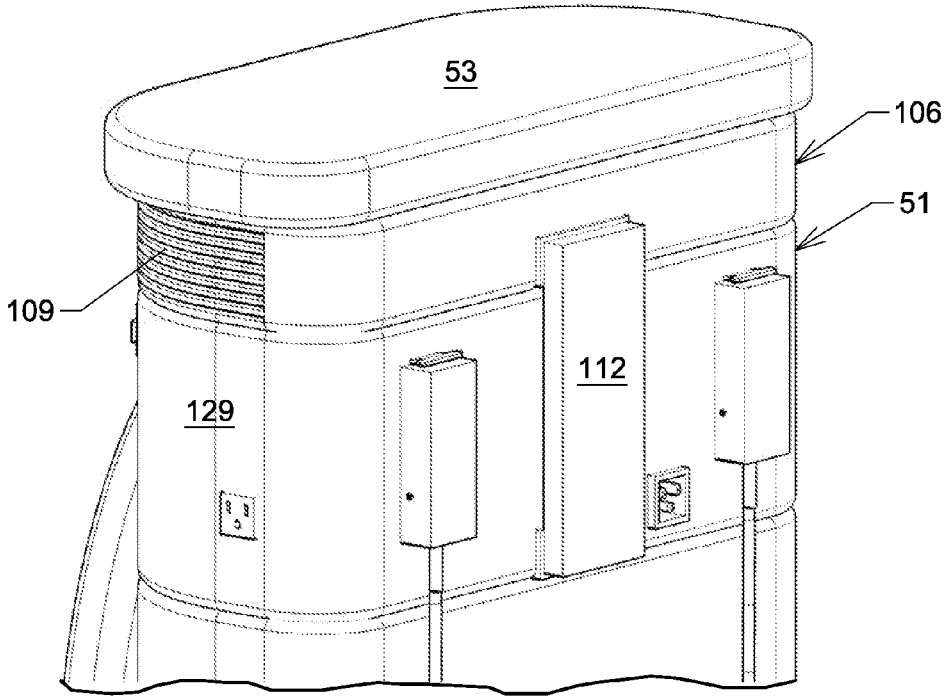
FIG. 33 is a rear perspective view of the air filtration unit as attached to the modular case and illustrates how the exhaust duct from the modular case is connected to the filter unit.
Figure 38:
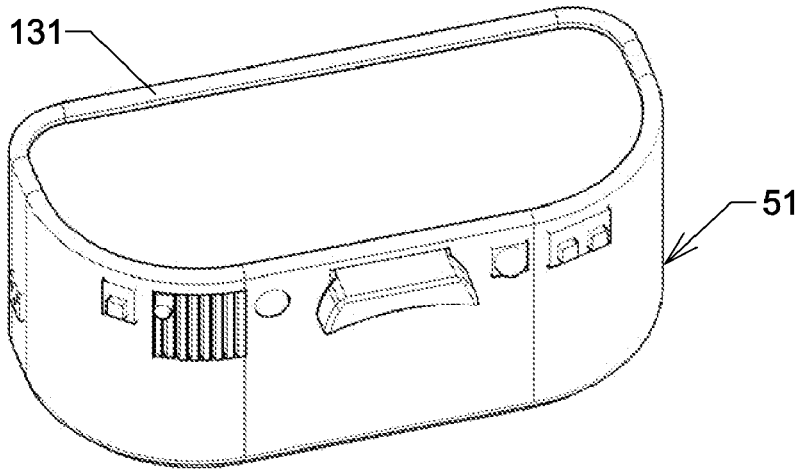
FIG. 38 is a front perspective view of the modular case to illustrate the rim on its top that is designed to engage the water tank lid or any other modular case or device.
Figure 39:
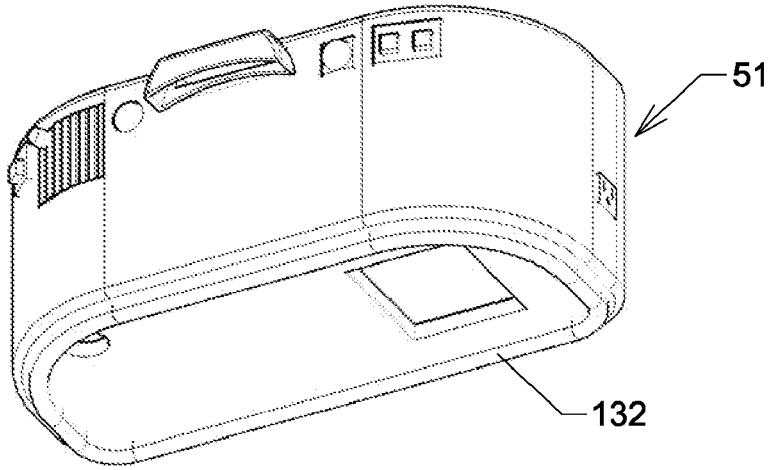
FIG. 39 is a bottom perspective view of the modular case to illustrate the modular case guide that is used as a slide fit to engage and hold the modular case onto the water tank.
Figure 40:
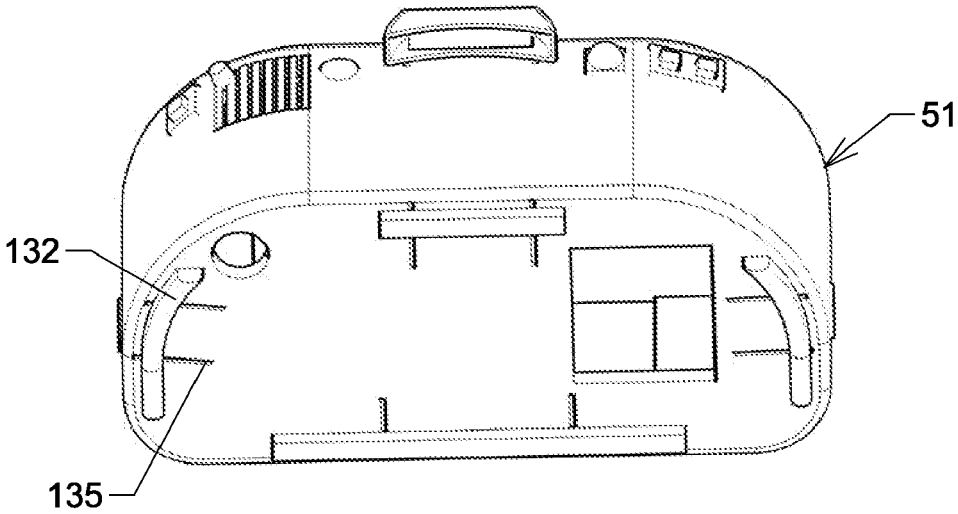
FIG. 40 is a bottom perspective view of the modular case to illustrate the adjustable nature of a generic modular case guide that is used to engage and hold the modular case onto many different shaped water tanks.

Component Modular Case Design:

Yet another aspect of the modular case assembly 51 is that it is designed to function as a component device, allowing other modular devices to fit onto it whereby they could work in concert with it or can work completely independently from it. Although the modular case assembly 51 can be supplied with its own top, the modular case assembly 51 is designed to utilize the stock toilet water tank lid 53 so that it can better blend in with the existing toilet. This feature allows for a modular case rim 131 mounting area on the modular case assembly 51 top for the mounting of a lid but also allows the device to again be modular by allowing other types of modular cases to be stacked on top of it in place of a lid. A lid can finally be installed on the highest modular case. FIGS. 32 and 33 illustrates an air filtration unit 106 as mounted onto the modular case assembly 51. FIG. 38 illustrates the modular case rim 131 and FIG. 29 illustrates the air filtration mounting guide 111 that mates with the modular case rim 131 to hold the units together. Depicted in FIG. 39, the modular case assembly 51 also has a case mounting guide 132 that holds it in place onto the water tank 52. FIG. 40 illustrates adjustable modular case mounting guides 132 that can slide on adjustable guide slots 135 that will allow a positive fit for a one sized modular case assembly 51 to be installed on a large variety of water tank shapes.

Figure 37:
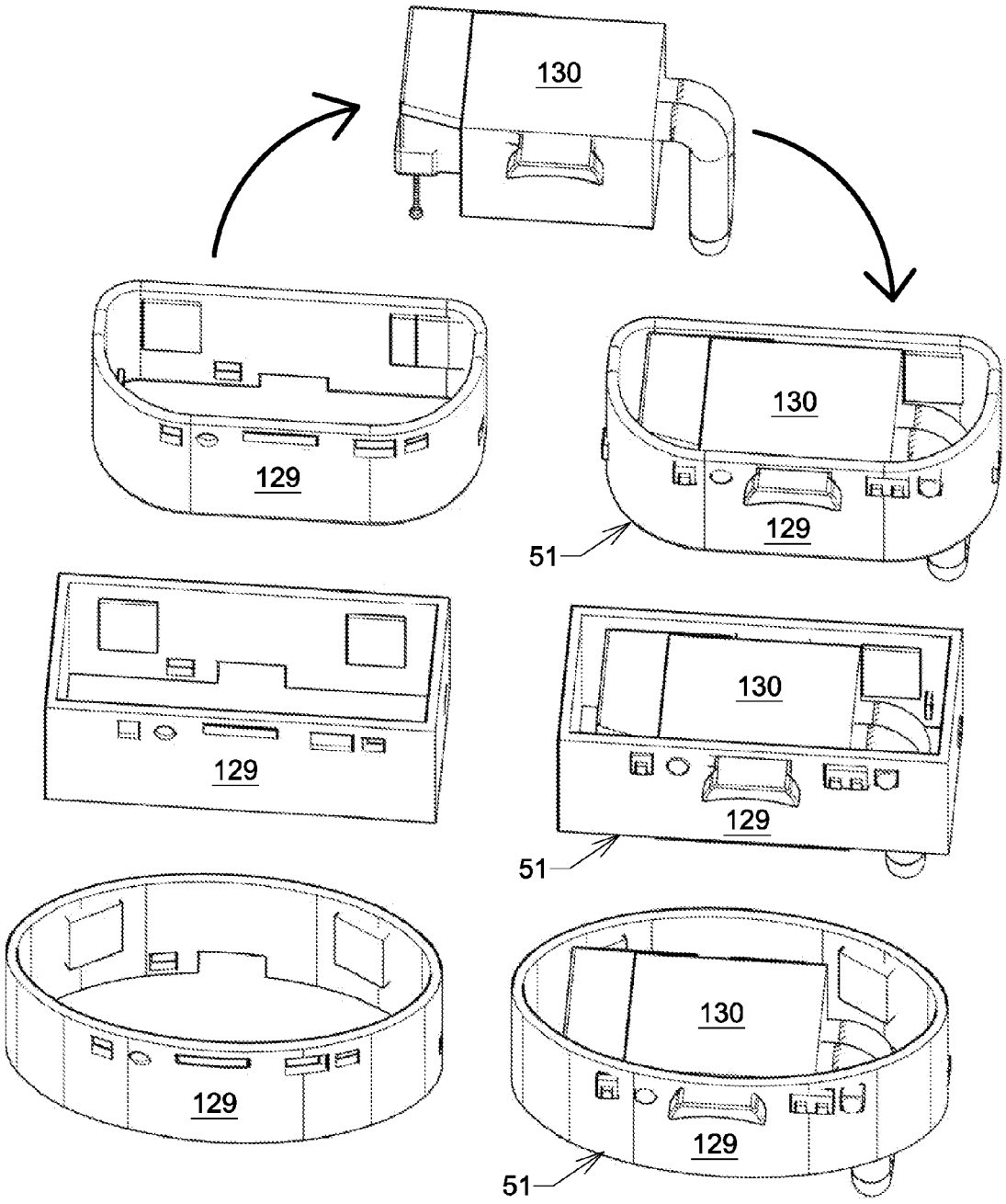
FIG. 37 is an illustration of how several case shapes or "skins" can be combined with a generic modular unit to produce a modular case.

Universal Generic Case Assembly:

Not only is the modular case assembly 51 modular by virtue of its many optional plug-in components and the numerous configuration possibilities, but the assembly of the basic components inside the case is intended to be modular as well. A single, generic case assembly 130 of the essential internal components of the modular case assembly 51 can be packaged so that it can then be economically mass produced to be installed onto many brands or models of available toilets. FIG. 37 illustrates this generic case assembly 130 as installed into several modular case skins 129 which are just different case shapes. FIG. 40 illustrates adjustable guide slots 135 on the bottom of the generic case assembly that allows the mounting guides to adjust to any water tank shape.

Generic Modular Case Skin:

A generic modular case skin 129 can be designed to be aesthetically acceptable on a wide range of toilet models. This would minimize the need to produce a large number of modular case skins 129 that would be necessary to perfectly fit the extremely large variety of existing toilet designs. That way, a single modular case skin 129 design that contains said universal generic case assembly 130 could be made available in a basic kit to satisfy a very large base of existing installed toilets. This again further enhances the ability for this product work in any situation, which provides the consumer the ability consider and to utilize the device.

Seat and Seat Lid Warmer Power:

Another feature of the modular case assembly 51 is that it can be used to provide power to a seat and/or seat lid warmer. The seat 58 and seat lid 54 of this invention can use heating elements that can be fabricated into the seat and seat lid material. The modular case can provide a convenient seat warmer power outlet jack 133 which would allow safe low voltage power to be accessed using wire connections from the jack 133 to the seat 58 and seat lid 54. FIG. 7 illustrates this jack 133 on the back side of the modular case assembly 51.

Figure 28:
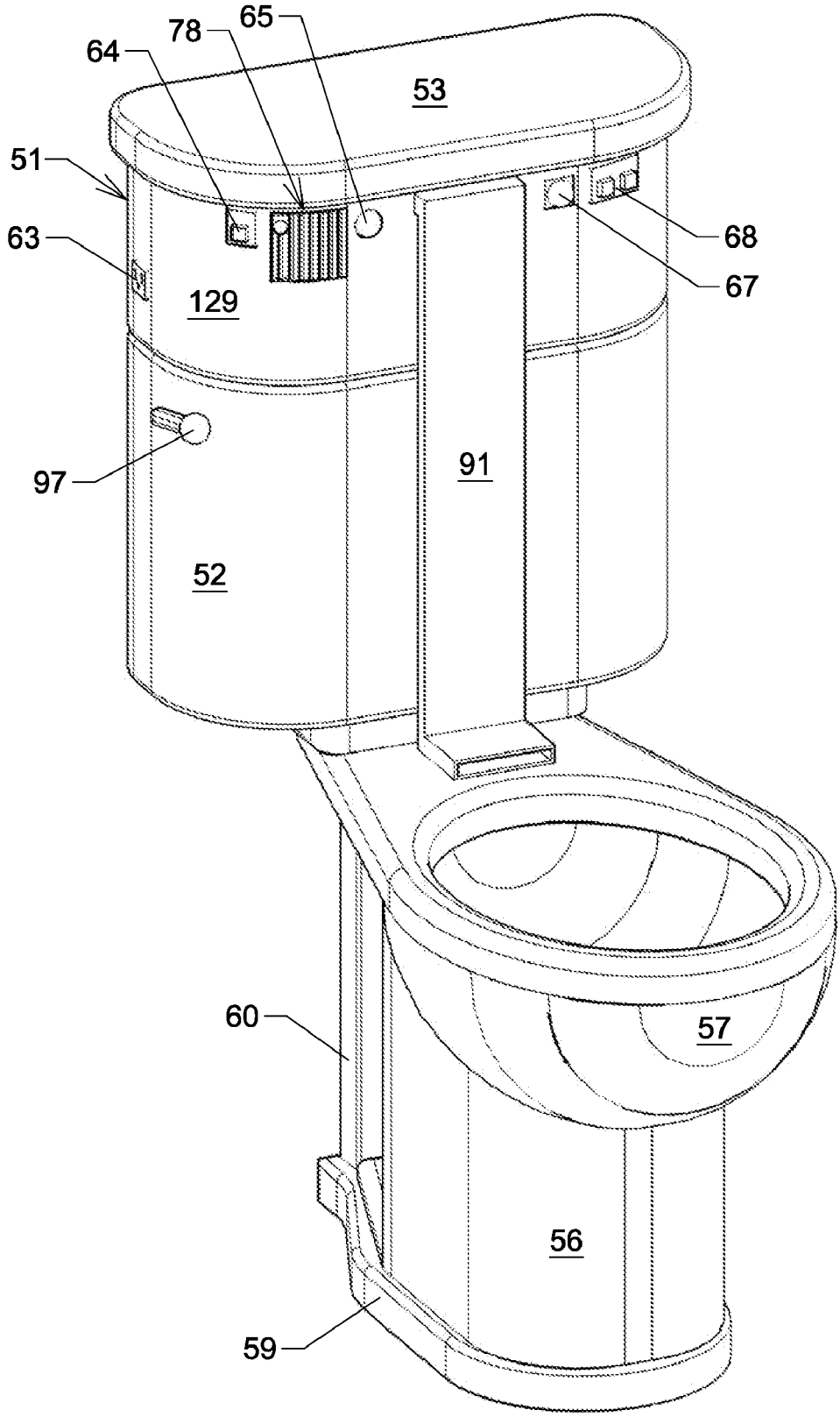
FIG. 28 is a perspective view of the invention but with the seat and seat lid removed to illustrate the use of an optional toilet bowl duct instead of using the specially designed seat and seat lid assembly.

Optional Ventilation Configurations:

The modular nature of the current invention provides for embodiments that allows for numerous different ventilation configurations. The following demonstrate just a few embodiments of the optional configurations that make use of the modular design of this invention:

(1) Configuration without the Special Seat or Seat Lid:

FIG. 28 illustrates one such embodiment where an optional toilet bowl ventilation duct 91 is used instead of the previously mentioned special purpose seat lid 54 and seat 58. This would allow the consumer the ability to retain the use a stock seat and seat lid but yet still be able to utilize the ventilation feature of this invention. This ventilation duct 91 could be fastened in place with a Velcro strip or other fastener that would allow it to be removed as needed for cleaning. This duct could also be designed to snap apart for cleaning.

Figure 35:
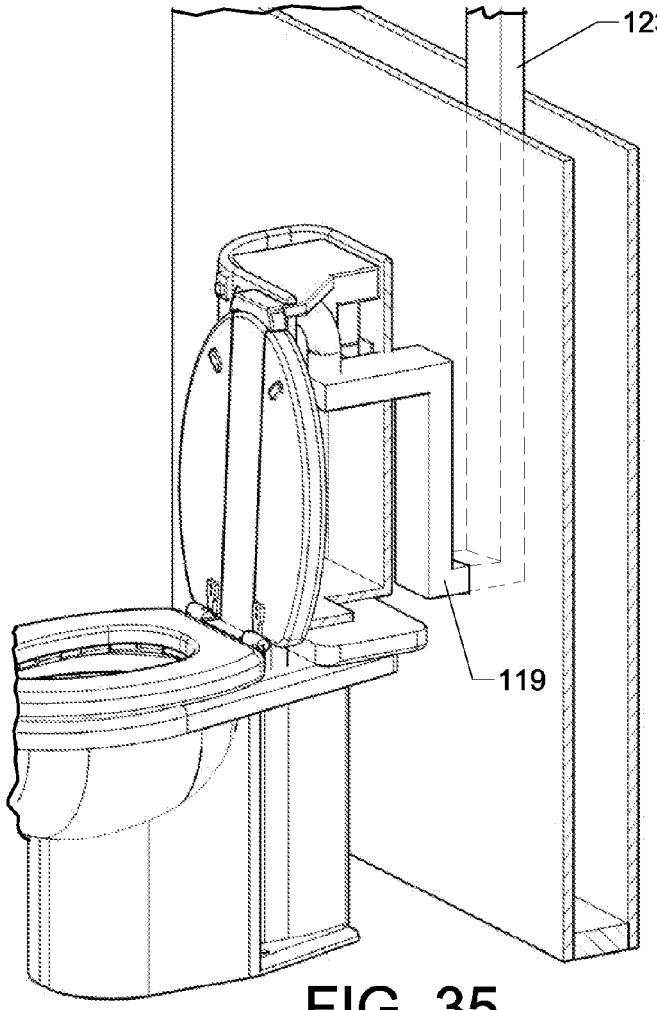
FIG. 35 is a front perspective and sectional view of the invention with a modular duct option attached that can be used when a building exhaust vent is available which eliminates the exhaust manifold and some other components inside the modular case.

(2A) Bathroom Wall Vent Utilization:

Another embodiment of the present invention is for the device to make use of any existing bathroom capabilities, such as an available wall exhaust duct 123, depicted in FIG. 35. In this case, the toilet exhaust manifold 59 would not be needed nor would some of the components inside the modular case assembly 51, such as the P-Trap 77 or Ball-Trap 85. A kit could be offered in this configuration so that only an exhaust duct 119 between the modular case assembly 51 and the wall vent duct 123 would be needed as illustrated in FIG. 35.

Figure 36:
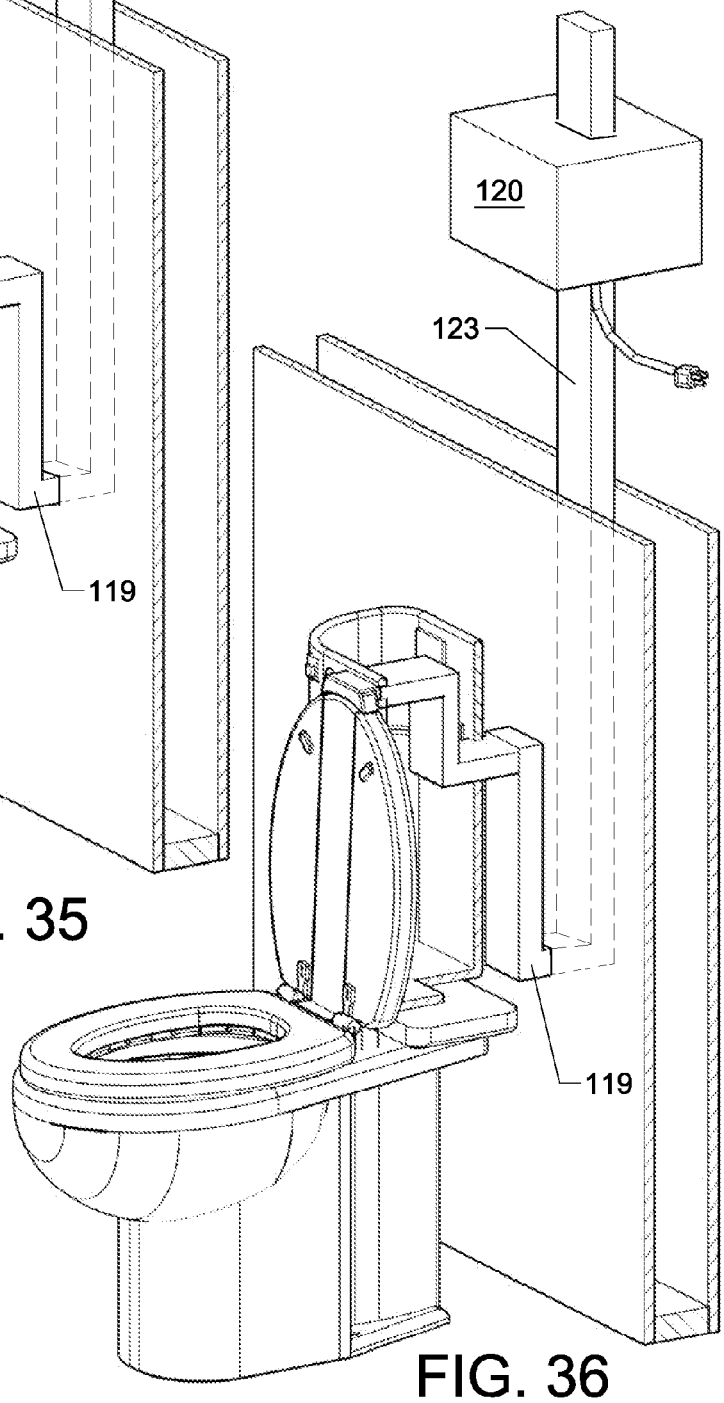
FIG. 36 is a front perspective and sectional view of the invention with a modular duct option attached that can be used when a building exhaust vent and external fan is available to use which eliminates the exhaust manifold, the vacuum pump and some other components inside the modular case.

(2B) Bathroom Wall Vent Utilization with External Fan:

Further, if this bathroom exhaust vent also is equipped with a remote, attic mounted vacuum pump 120, then the vacuum pump 75 inside the modular case assembly 51 can also be omitted as illustrated in FIG. 36. These capabilities would allow the use of the other various components of the current invention as well as the other optional features.

Figure 30:
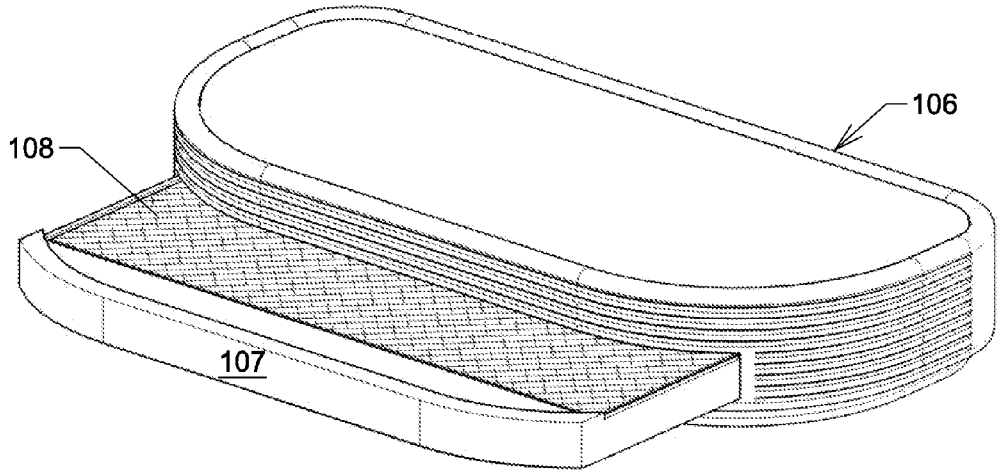
FIG. 30 is a front perspective view of the air filtration unit with the air filter drawer pulled open to illustrate the air filter as mounted horizontally inside the drawer.
Figure 31:
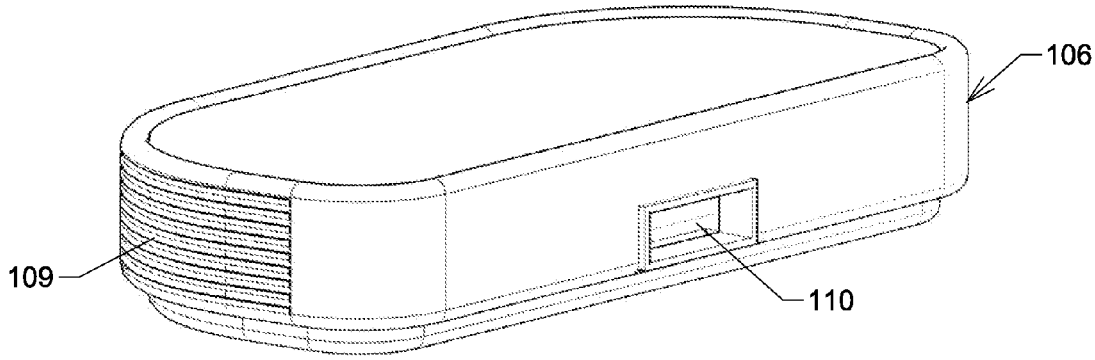
FIG. 31 is a perspective view of the backside of the air filtration unit illustrating the exhaust inlet duct.

(3A) Air Filtration Unit—Modular Toilet Mounted Design Option:

Still another embodiment of this invention is to allow the consumer the ability to use an air filtration unit 106, if desired as depicted in FIGS. 32 and 33. The modular nature of this invention will even serve to give the consumer several options for any available air filtration unit. FIGS. 29, 30 and 31 illustrates another feature of this invention, where a water tank 52 mounted air filtration unit 106 is designed to work with the modular case assembly 51. This device uses a chemically treated charcoal filter 108 or other material to filter out odor from the air. The filter can be replaced from the air filter unit 106 by pulling out the air filter drawer 107 to gain access to the filter 108. Air enters the air filtration unit via a duct 110 concealed on the anterior surface of the unit, flows through the air filer 108 and then exits the device through front and side vents 109. The whole air filtration unit simply is placed on top of the modular case assembly 51 as depicted in FIGS. 32 and 33 and securely rests there by using the mounting guide 111 located on the underside of the air filtration unit that mates with the rim 131 on the modular case assembly 51. An air filtration exhaust duct 112 connects the air filtration unit with the exhaust duct from the modular case assembly 51 depicted in FIG. 33.

Figure 34:
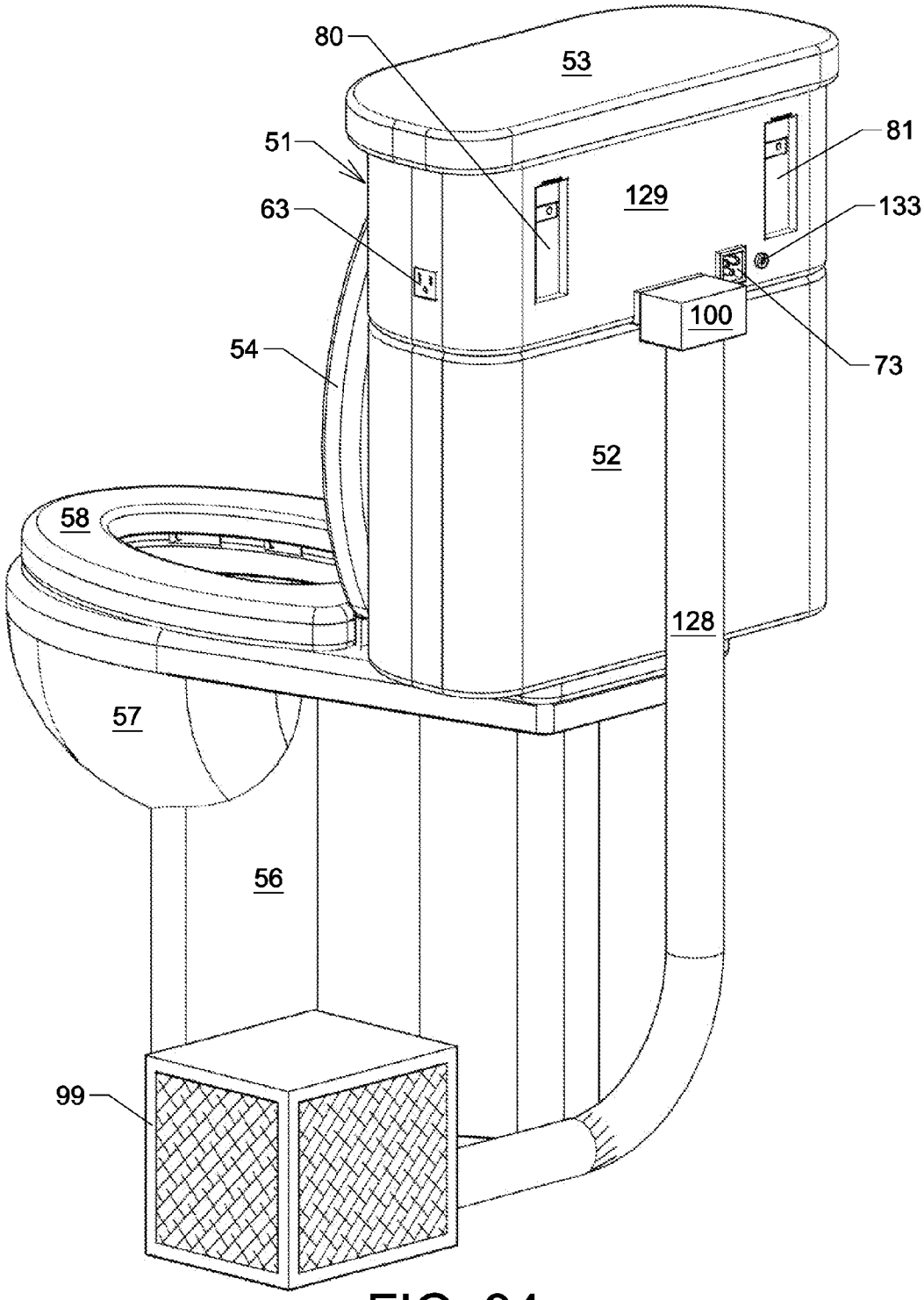
FIG. 34 is a rear perspective view of the invention with a remote air filtration unit attached and the ductwork to connect it from the modular case.

(3B) Air Filtration Unit—Remotely Mounted Option:

Still yet another embodiment of the current invention that uses air filtration is shown in FIG. 34. The system can utilize any available industry standard air filtration unit 99 simply by connecting the unit to the modular case assembly 51 with simple ducts 128 and 100. This air filtration unit 99 could have its own internal vacuum pump or could make use of the one available in the modular case assembly 51. Again, a kit could be available for any type of configuration, where optional parts are included or omitted according to the consumers' needs.

What is claimed is:

1. A multifunction toilet apparatus for use with a toilet having a water tank and bowl that is designed to automate various toilet area functions and can operate using any one or number of its features, comprising:

a) a modular case assembly mounted onto said water tank having a front side, back side, top side with a rimmed edge and bottom side with a mounting guide and defining an interior space and exterior surface for mounting of components and having an inlet duct aperture located on the said front side of said case and an outlet duct aperture located on said back side of said case comprising:

i) a ventilation apparatus that vacuums air inside said front side of said case and exhausts it to said rear of said case comprising:

(1) a fan and fan housing with an inlet aperture and an outlet aperture as disposed within said case interior space;

(2) an intake passage duct as protruding from said front of said case inlet aperture and connected to said fan inlet aperture through which said fan draws air from the outside of the said front of said case and into said fan;

(3) a U-shaped tube with a bottom end that contains a small orifice which said tube is mounted inside said case with one end of said tube attached to said fan outlet aperture to communicate air from said fan into said U-shaped tube and said U-shaped bottom end portion of tube protrudes down through said bottom side of said case to be disposed below said case low enough so as to enter the water contained inside said water tank and for said bottom end of said tube to be submerged in said water thereby filling said tube with said water through said orifice to completely fill said tube to block gas migration, whereby the water will be blown out of said tube to allow airflow through said tube once said fan is activated and will refill with water using said orifice once said fan is deactivated for sewer gas backflow prevention;

(4) a second sewer gas backflow prevention apparatus that is a three chamber device where the first chamber is a short straight and horizontally mounted tube that is open on both ends; a second chamber that is also a short tube and is in line with said first chamber but has a larger diameter and ramps upwards at a slight angle where the lower end of said tube is open and connected to said first chamber tube to communicate air from said first chamber tube and the other higher end of said second chamber tube is closed; a ball that resides within said second chamber tube that has a diameter slightly less than said second chamber tube's diameter so that said ball is allowed to freely move up and down the length of said tube and normally rolls to a rest at the bottom of said second chamber device but cannot enter said first chamber tube because of its larger diameter; a round exhaust aperture located in the bottom side of the lower end of said second tube that has less diameter than said ball of which said ball rests on said aperture to seal the opening closed; a third chamber that is a duct that has an exhaust aperture on one side and an aperture on the top end farthest from said exhaust aperture on the side and is aligned below said second chamber so that said top duct aperture is matched with the aperture in the bottom end of said second chamber thus providing a fluid communication of air through all three chambers; whereby said ball normally rests on said aperture with gravity to seal the passage of air through said ducting device and whereby said ball rolls up off the orifice into said ramped tube to allow airflow through said orifice once said fan is activated and will roll back into place onto said orifice once said fan is deactivated a backup measure for sewer gas backflow prevention;

(5) an outlet duct that connects to said second sewer gas backflow prevention apparatus to said outlet aperture and extends outside of said backside of said case thereby allowing air to flow from said sewer gas apparatus to exit said case;

(6) a magnetic switch disposed in said front of said case, actuated when encountering a magnetic field from a magnet that is inserted into the top edge of said toilet seat lid as said seat lid fully opens and said magnet activates said magnetic switch;

(7) an electronic control module that contains circuitry for multiple purposes including the purpose of controlling the activation and deactivation of the ventilation system;

(8) whereby completing an air communication channel from said front of said case to said back of said case providing two means of sewer gas backflow prevention and whereby having a means from said magnetic switch and said control module to provide automation;

ii) an apparatus for motion control of a typical toilet seat and seat lid that allows said seat and seat lid to mechanically open and close, comprising:

(1) a motor and clutch assembly comprising:

(a) an electric motor;

(b) a gearbox with a gearbox drive shaft;

(c) a linear actuator output shaft;

(d) a long semi-rigid flexible rod that is coupled to said linear actuator output shaft;

(e) a clutch mechanism comprising:

(i) means whereby turning of said gearbox drive shaft causes said linear actuator output shaft to move linearly, resulting in a linear movement of said flexible rod;

(ii) means whereby said gearbox drive shaft can slip and become uncoupled from said linear actuator output shaft once a predetermined amount of force is exerted on said flexible rod;

(f) a modular housing for said motor, gearbox and clutch mechanism with an external modular contact terminal port for the electrical connection of said motor to a power source with said electrical terminals protruding thereof;

(g) a latching mechanism on said housing that will allow said housing to snap into and remain in place as disposed into a receiving socket;

(h) a guide tube that is open on both ends whereby one end is rigidly fixed into said modular housing of said motor and clutch assembly and whereby said guide tube extends a predetermined length from said housing whereby said flexible rod resides internally of said tube whereby a predetermined length of said rod protrudes from the open end of said tube opposite of said housing;

(i) whereby said electric motor and said gearbox causes said gearbox output shaft to rotate whereby said clutch mechanism provides a means for linear motion and a clutch action to said linear actuator shaft whereby said linear actuator shaft then actuates said flexible rod that is positioned inside said guide tube whereby said rod can move and have linear motion as protruding from said tube;

(2) two sockets, one for said seat lid motor assembly and one for said seat motor assembly, disposed on said back side of said case exterior comprising:

(a) a means for detachably mounting said seat lid motor and said seat motor assemblies into said sockets allowing said motors to be easily installed and removed;

(b) a means for electrical circuit connectivity between said case sockets and said motor assemblies that allows an instant electrical connection as said motors are installed into said sockets;

(3) an electronic control module mounted inside said case that contains circuits to control the said seat and seat lid motor assemblies and to provide automation;

(4) a proximity sensor mounted on said front exterior of said case that senses the occupancy and vacancy of said toilet and is connected to said electronic control module for automation control of said seat lid and said seat;

(5) a switch panel mounted on said front exterior of said case to allow control of said seat lid and seat motors;

(6) a household power supply inlet jack mounted on said back side of case to provide standard household power to the circuitry and components inside said case;

(7) whereby said switch panel provides a signal to said electronic control module whereby said power is applied to said motor and clutch assemblies thereby causing movement to open said seat and seat lid and whereby said proximity sensor can sense the occupancy and vacancy of said toilet and to provide a signal to said control module whereby said control module will apply said power to said motor assemblies to automatically close said seat and said seat lid;

iii) a sound generation module that is detachably mounted to said front of said case comprising:

(1) a speaker element for the generation of sound;

(2) an apparatus that contains a signal amplifier and circuits to store and select a variety of recorded sounds and for volume control;

(3) a means to allow a user to control said device to vary the volume and to select the said variety of recorded sounds, including control to power on and off said apparatus;

(4) a grill so that sound may travel from said speaker to the outside of said case;

(5) an electronic control module that is connected to said apparatus for the purpose of automatic control;

(6) whereby said sound generation module can automatically produce a variety of sounds at a controlled volume;

iv) a toilet flushing apparatus comprising:

(1) an apparatus that is detachably mounted inside of said case capable of exerting enough lifting force on said toilet's existing flush handle actuator lever to flush said toilet;

(2) a means of attachment of said apparatus to said flush handle actuator lever that is easily detachable;

(3) a proximity sensor mounted on said front panel of said case to sense the occupancy and vacancy of said toilet;

(4) an electronic control module;

(5) whereby said electronic control module uses said proximity sensor as an input signal to provide toilet occupancy and vacancy data thereby said circuit provides intelligent logic and timing for a flush action to be initiated thereby activating said flushing apparatus that exerts lifting force on said flush actuator lever so that said toilet can be automatically flushed;

v) a proximity sensor mounted on said front panel of said case that is free of interference from the opening and closing of said toilet seat lid for the purpose of detecting the use of said toilet to activate automation devices;

vi) a motion detector disposed on said front exterior of said case that is free of interference from the opening and closing of said toilet seat lid for the purpose of detecting any motion in the vicinity of said toilet to activate automation devices;

vii) at least one power receptacle mounted on said side of said case and electronic control module to provide automatic switchable power to said receptacle;

viii) an electric transformer disposed inside said case and a power outlet jack installed on said backside of said case and to supply low voltage power to an available product such as a seat and seat lid warming device;

ix) an electronic control module disposed inside said case that has electrical connectivity to the various components utilized with said case that contains circuits that provide monitoring and control said components thereby providing a means for automatic control of said components;

x) said rimmed edge that allows the original tank lid to be utilized thereof;

xi) said rimmed edge that allows other devices to be mounted thereof;

b) a ventilation apparatus for removal of toilet bowl odors for use with a typical toilet having a water tank and bowl comprising:

i) a normally horizontal vented toilet seat having a forward end portion and a rearward end portion and an inside seat rim with a plurality of inlet apertures therein for drawing odorous air from the vicinity of said seat rim inside the seat to be communicated with an outlet opening at the rearward end portion of said seat forming an air passageway from said inlet apertures to the outlet opening at said rearward end portion of said seat;

ii) a hinged open and upright toilet seat lid having a top edge portion and a bottom edge portion and having an tubular interior space that communicates an inlet aperture at said bottom edge of said lid to an outlet aperture at said top edge of said seat lid thereby forming a ductwork completely through said seat lid from said bottom edge to said top edge;

iii) a joint that is formed when said seat lid is hinged open in an upright position and said bottom edge portion of said seat engages and mates with said rearward end portion of said seat to perfectly complete an air duct channel from said plurality of inlet apertures in said seat rim to said top edge portion of said seat lid;

iv) a joint that is formed when said seat lid is hinged open and said top edge portion of said seat lid engages and mates with said intake passage duct as it protrudes from said case to perfectly complete an air duct channel from said seat lid interior to the fan thus completing an air duct channel from said plurality of inlet apertures in said seat rim to said fan;

v) an exhaust manifold adapted to be mounted under said toilet bowl base, between said toilet bowl base and a sewer drain, said exhaust manifold having a through passageway communicating air from an exterior inlet aperture at the top back end of said manifold through said passageway to said sewer drain;

vi) an exhaust duct that connects said case outlet duct on said back side of said case to said exhaust manifold inlet aperture at said top back end of said manifold to complete the air communication channel from said case to said sewer drain;

c) said apparatus for motion control of a typical toilet seat and seat lid that allows said seat lid and seat to mechanically open and close comprising:

i) a hinged lever mechanism as mounted to said seat lid such that by pivoting the lever, said seat lid can be hinged opened and closed;

ii) a hinged lever mechanism as mounted to said seat such that by pivoting the lever, said seat can be hinged opened and closed;

iii) a guide tube that extends from each of said motor assemblies on the outside said back of said case, one guide tube that extends to the close vicinity of said seat lid hinged lever mechanism and the other guide tube that extends to the close vicinity of said seat hinged lever mechanism;

iv) two brackets that that are each attached to said toilet using the same fasteners that said seat and said lid hinged lever mechanisms use to attach said seat lid and seat, one of said brackets mounts on one side of said hinged lever mounting fastener for the seat lid and the other said bracket using said hinged lever mounting fastener for the seat whereby the brackets become rigid to said toilet and are used to function as an attachment and anchoring point for said guide tubes;

v) a linear actuator rod that is installed inside said guide tubes and are each connected each to the motor assembly at one end and protrudes from said guide tube with a means to engage said hinged lever mechanisms where said rod can move inside said guide tube to transfer motion from said motor assembly through said guide tube to said hinged mechanism;

vi) whereby activation of said lid motor assembly causes said rod to move inside said guide tube thereby actuating said lid lever thereby opening or closing said seat lid;

vii) whereby activation of said seat motor assembly causes said rod to move inside said seat guide tube thereby actuating said seat lever thereby opening or closing said seat;

viii) whereby said electronic control module and said proximity sensor provides a means for automation;

d) an air filtration apparatus that can be utilized with said modular case ventilation apparatus comprising:

i) a modular housing that can be installed onto said modular case and having a front side, back side, top side with a rimmed edge and bottom side with a mounting guide and defining an interior space having two compartments comprising an upper compartment and a lower compartment comprising:

(1) an inlet aperture disposed on the back of said housing allowing an aperture into said lower compartment for receiving odorous air;

(2) a drawer in said housing disposed between said two compartments for mounting an air filter and providing an air communication path to said top compartment through said drawer cavity and through said air filter;

(3) an air filter removably inserted within said air filter drawer;

(4) air outlet vents disposed on said front and said sides of said housing in fluid communication with said top compartment;

(5) whereby completing an air communication channel from said inlet aperture disposed on the back of said housing through said filter and then ventilated outside said housing through said air outlet vents;

ii) a duct to connect said outlet duct on said modular case to said inlet aperture on said air filtration apparatus;

iii) said rimmed edge to connect other components to said top of said housing;

iv) said mounting guide to mount said air filter housing to said modular case;

v) whereby said air filtration provides for its own mounting onto said modular case and provides for an air passageway from said modular case through said filter mounted therein to process odor filled air thereby discharging clean air into the bathroom.

2. The invention of claim 1 whereby said case is shaped to match and blend in with said toilet tank thereby disguising itself and its internal components in order to make the apparatus inconspicuous and aesthetically pleasing.

3. The invention of claim 1 whereby said intake passage duct as protruding from said front of said modular case inlet aperture is made to be retractable so that it becomes flush with said modular case while said ventilation apparatus is off for aesthetics and to automatically extend upon activation of said ventilation apparatus.

4. The invention of claim 1 whereby a water valve is disposed inside the bottom of said U-shaped tube over the top of said orifice to plug off said orifice during the ventilation operation for the benefit of keeping the orifice clean and to prevent water leakage back into said tube during operation that is achieved by the force of air pressure on said water valve inside said tube during operation that pushes the water valve down against the orifice thus closing it and whereby in the absence of air pressure in said tube allows said water valve to float up away from said orifice so that said tube can refill with water.

5. The invention of claim 1 whereby said toilet seat and lid motion control panel includes two proximity switches that can be activated when a finger is within close proximity of said switch without the need to actually touch said switch thereby providing a completely hands free and sanitary means of raising and lowering said seat lid and said seat.

6. The invention of claim 1 whereby said electronic control module provides electronic circuit connections externally from said case in order to transmit data with external devices.

7. The invention of claim 1 whereby said seat rim ventilation apertures are formed when a flat removable cover on said bottom of said seat having a raised edge along the inside rim with apertures along the topside of said rim and is removably fitted onto the bottom of said seat where a cavity is then formed and with said apertures allowing fluid communication of bowl air into said cavity for the purpose of ease of cleaning.

8. The invention of claim 1 whereby the ventilation system can be configured to use a standard remotely mounted, fanless air filtration unit that is attached to said exhaust duct of said modular case with a duct.

9. The invention of claim 1 whereby the ventilation system can be configured to use a standard remotely mounted fan powered air filtration unit that is attached to said exhaust duct of said modular case with a duct.

10. The invention of claim 1 whereby said ventilation system can be configured to use an existing bathroom fanless exhaust vent by attaching a duct from said exhaust duct of said modular case to said exhaust vent.

11. The invention of claim 1 whereby said ventilation system can be configured to use an existing bathroom fan powered exhaust vent by attaching a duct from said exhaust duct of said modular case to said exhaust vent.

12. The invention of claim 1 whereby the stock seat and seat lid can be retained while still using said ventilation system by the use of a ventilation duct which is a thin vertical tube with an aperture at the bottom end of said tube and an aperture at the top end of said tube and is shaped to draw odorous air from said toilet bowl up to said intake duct from said front of said modular case and can be detachably mounted on the water closet.

13. The invention of claim 1 whereby said air filtration apparatus is combined with said ventilation system into a single housing.

14. The invention of claim 1 whereby any of components in part or in total is manufactured in combination with a new toilet.

* * * * *

UNITED STATES PATENT AND TRADEMARK OFFICE

CERTIFICATE OF CORRECTION

PATENT NO. : 7,380,292 B1
APPLICATION NO. : 11/935672
DATED : June 3, 2008
INVENTOR(S) : Robert Harris It is certified that error appears in the above-identified patent and that said Letters Patent is hereby corrected as shown below:

On the Title Page, Item (76) reads,

Inventor:
Robert Harris
P.O. Box 972
North Highlands, CA 95660

On the Title Page, Item (76) should read,

Inventor:
Robert Harris
P.O. Box 1227
Roseville, CA 95678

Signed and Sealed this

Fifth Day of August, 2008

JON W. DUDAS
*Director of the United States Patent and Trademark Office*